US011559085B2

(12) United States Patent
Fujinaga et al.

(10) Patent No.: US 11,559,085 B2
(45) **Date of Patent: *Jan. 24, 2023**

(54) POWER SUPPLY UNIT FOR AEROSOL INHALER, AEROSOL INHALER, AND AEROSOL INHALE SYSTEM

(71) Applicant: Japan Tobacco Inc., Tokyo (JP)

(72) Inventors: Ikuo Fujinaga, Tokyo (JP); Takuma Nakano, Tokyo (JP); Hajime Fujita, Tokyo (JP); Keiji Marubashi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/489,811

(22) Filed: Sep. 30, 2021

(65) Prior Publication Data

US 2022/0095687 A1 Mar. 31, 2022

(30) Foreign Application Priority Data

Sep. 30, 2020 (JP) ..... JP2020-166296

(51) Int. Cl.

| | |
|---|---|
| ***A24F 40/51*** | (2020.01) |
| ***A24F 40/53*** | (2020.01) |
| ***A24F 40/57*** | (2020.01) |
| ***A24F 40/60*** | (2020.01) |

(52) U.S. Cl.

CPC ..... *A24F 40/51* (2020.01); *A24F 40/53* (2020.01); *A24F 40/57* (2020.01); *A24F 40/60* (2020.01)

(58) Field of Classification Search

None

See application file for complete search history.

(56) References Cited

U.S. PATENT DOCUMENTS

| | | | |
|---|---|---|---|
| 2015/0136153 | A1 | 5/2015 | Lord |
| 2017/0071251 | A1 | 3/2017 | Goch |
| 2018/0338531 | A1 | 11/2018 | Reevell |

(Continued)

FOREIGN PATENT DOCUMENTS

| | | | |
|---|---|---|---|
| EP | 3 138 424 | A1 | 3/2017 |
| JP | 2015-517312 | A | 6/2015 |

(Continued)

OTHER PUBLICATIONS

Notice of Reasons for Refusal dated Jan. 12, 2021, received for JP Application 2020-166296, 7 pages including English Translation.

(Continued)

*Primary Examiner* — Phu H Nguyen

(74) *Attorney, Agent, or Firm* — Xsensus LLP

(57) ABSTRACT

A power supply unit for an aerosol inhaler, which causes an aerosol generated from an aerosol source to pass through a flavor source to add a flavor component of the flavor source to the aerosol, includes: a power supply configured to be dischargeable to a first load configured to heat the aerosol source and dischargeable to a second load configured to heat the flavor source; and a processing device. The processing device determines whether the second load can heat the flavor source. When it is determined that the second load can heat the flavor source, the processing device starts or continues discharging from the power supply to the second load as second discharging before starting discharging from the power supply to the first load as first discharging.

15 Claims, 17 Drawing Sheets

(56) References Cited

U.S. PATENT DOCUMENTS

| | | | |
|---|---|---|---|
| 2020/0138109 | A1 | 5/2020 | Lord |
| 2020/0154766 | A1 | 5/2020 | Jeong |
| 2021/0169148 | A1 | 6/2021 | Nakano et al. |
| 2021/0195961 | A1 | 7/2021 | Marubashi et al. |
| 2021/0235769 | A1 | 8/2021 | Marubashi et al. |

FOREIGN PATENT DOCUMENTS

| | | | |
|---|---|---|---|
| JP | 2017-511703 | A | 4/2017 |
| WO | 2019/017654 | A2 | 1/2019 |
| WO | 2020/039589 | A1 | 2/2020 |
| WO | 2020/059049 | A1 | 3/2020 |
| WO | 2020/084779 | A1 | 4/2020 |
| WO | 2020/174624 | A1 | 9/2020 |

OTHER PUBLICATIONS

Decision to Grant dated May 25, 2021, received for JP Application 2020-166296, 5 pages including English Translation.

European Search Report dated Feb. 7, 2022, in corresponding European Application No. 21199797.8.

POWER SUPPLY UNIT FOR AEROSOL INHALER, AEROSOL INHALER, AND AEROSOL INHALE SYSTEM

CROSS-REFERENCE TO RELATED APPLICATIONS

This application claims priority to Japanese Patent Application No. 2020-166296 filed on Sep. 30, 2020, the content of which is incorporated herein by reference.

TECHNICAL FIELD

The present invention relates to a power supply unit for an aerosol inhaler, the aerosol inhaler, and an aerosol inhale system.

BACKGROUND ART

In recent years, there has been a device that can add a flavor component contained in a flavor source to an aerosol by passing the aerosol generated by heating a liquid through the flavor source, and can cause a user to inhale the aerosol containing the flavor component.

Devices described in WO 2020/039589, JP 2017-511703 T, and WO 2019/017654 include a heater that heats a liquid for aerosol generation and a heater that heats a flavor source.

In a device including such two heaters, an inhale port of an aerosol inhaler is often disposed close to the heater that heats the flavor source. Therefore, it is not preferable from a viewpoint of safety of the aerosol inhaler to energize the heater that heats the flavor source in a state where the flavor source cannot be heated. Further, there is a strong demand for miniaturization of the aerosol inhaler, and it is also desired to avoid wasting power supply.

It is an object of the present invention to provides a power supply unit for an aerosol inhaler, the aerosol inhaler, and an aerosol inhale system, which have high safety and can prevent waste of power accumulated by a power supply.

SUMMARY OF INVENTION

According to an aspect of the present invention, there is provided a power supply unit for an aerosol inhaler that causes an aerosol generated from an aerosol source to pass through a flavor source to add a flavor component of the flavor source to the aerosol. The power supply unit includes: a power supply configured to be dischargeable to a first load configured to heat the aerosol source and dischargeable to a second load configured to heat the flavor source; and a processing device. The processing device determines whether the second load can heat the flavor source. When it is determined that the second load can heat the flavor source, the processing device starts or continues discharging from the power supply to the second load as second discharging before starting discharging from the power supply to the first load as first discharging.

DESCRIPTION OF EMBODIMENTS

Hereinafter, an aerosol inhaler 1, which is an embodiment of an aerosol inhaler of the present invention, will be described with reference to FIGS. 1 to 5.

(Aerosol Inhaler)

Figure 1:
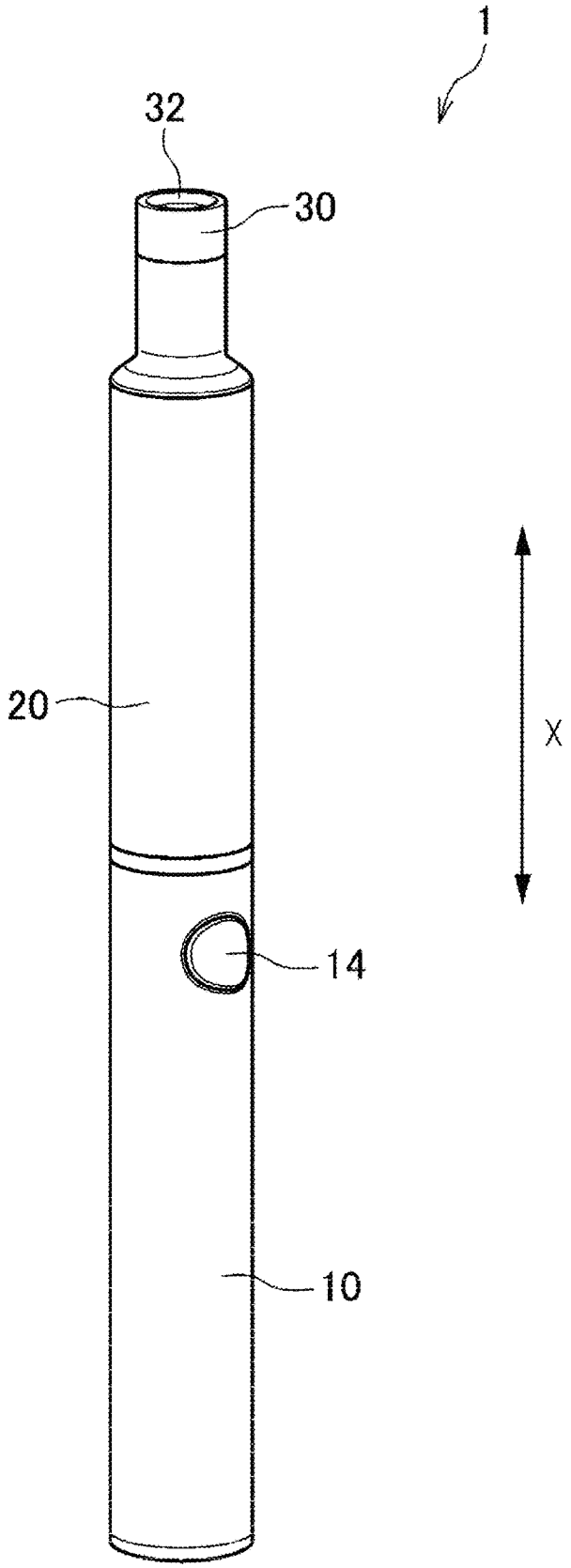
FIG. 1 is a perspective view schematically showing a schematic configuration of an aerosol inhaler.
Figure 2:
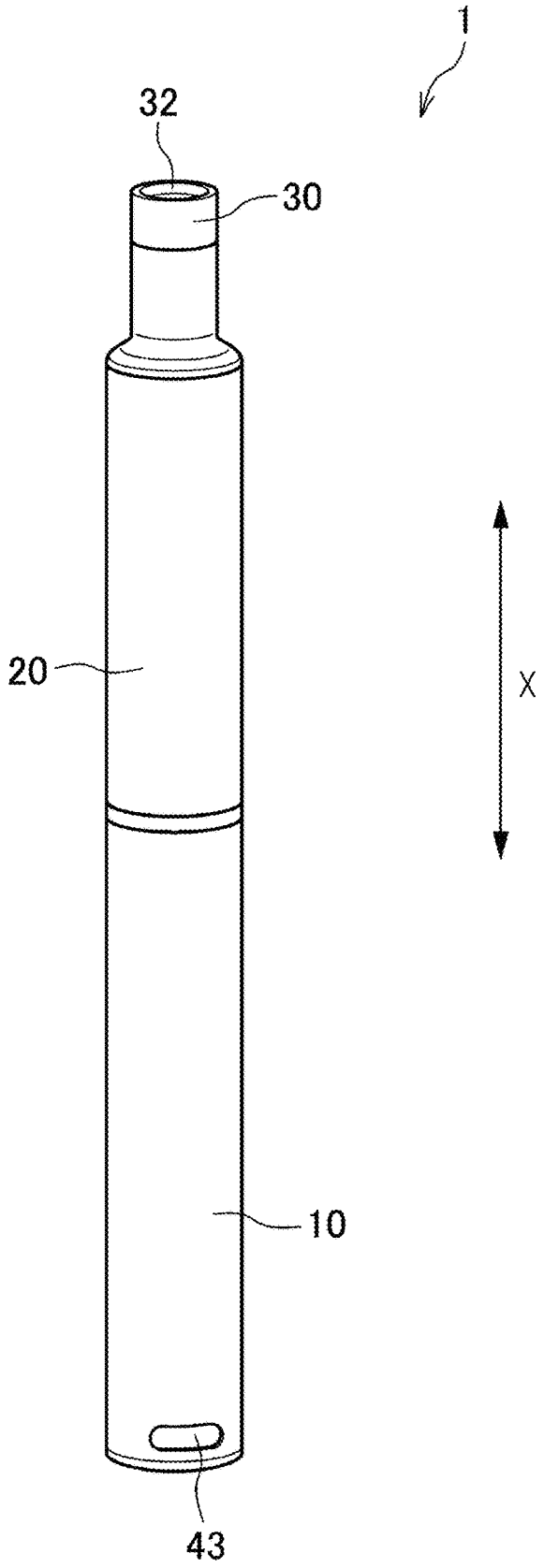
FIG. 2 is another perspective view of the aerosol inhaler of FIG. 1.
Figure 3:
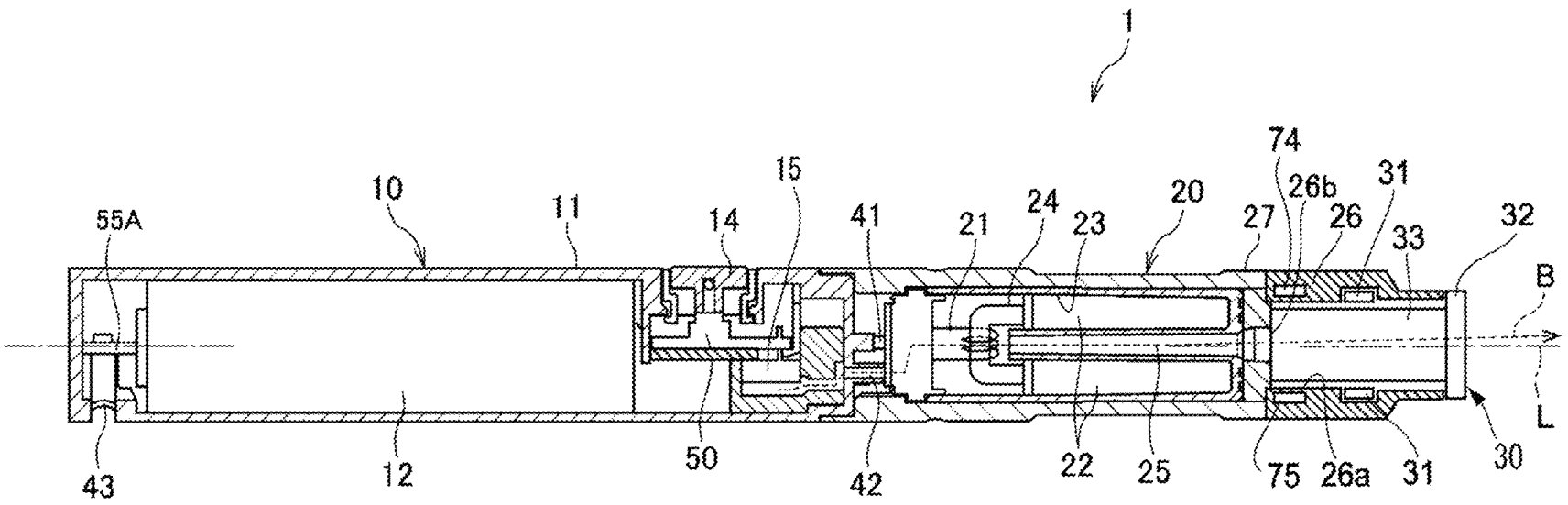
FIG. 3 is a cross-sectional view of the aerosol inhaler of FIG. 1.

The aerosol inhaler 1 is an instrument for generating an aerosol to which a flavor component is added without burning and allowing the aerosol to be inhaled, and has a rod shape that extends along a predetermined direction (hereinafter, referred to as a longitudinal direction X) as shown in FIGS. 1 and 2. In the aerosol inhaler 1, a power supply unit 10, a first cartridge 20, and a second cartridge 30 are provided in this order along the longitudinal direction X. The first cartridge 20 is attachable to and detachable from (in other words, replaceable with respect to) the power supply unit 10. The second cartridge 30 is attachable to and detachable from (in other words, replaceable with respect to) the first cartridge 20. As shown in FIG. 3, the first cartridge 20 is provided with a first load 21 and a second load 31, and the second cartridge 30 is provided with a flavor source 33.

(Power Supply Unit)

As shown in FIGS. 3 to 6, the power supply unit 10 houses a power supply 12, a charging IC 55A, a micro controller unit (MCU) 50, a DC/DC converter 51, an intake sensor 15, a capsule sensor 16, a temperature detection element T1 including a voltage sensor 52 and a current sensor 53, and a temperature detection element T2 including a voltage sensor 54 and a current sensor 55 inside a cylindrical power supply unit case 11.

The power supply 12 is a rechargeable secondary battery, an electric double-layer capacitor, or the like, and is preferably a lithium-ion secondary battery. An electrolyte of the power supply 12 may be composed of one or a combination of a gel-like electrolyte, an electrolytic solution, a solid electrolyte, and an ionic liquid.

Figure 6:
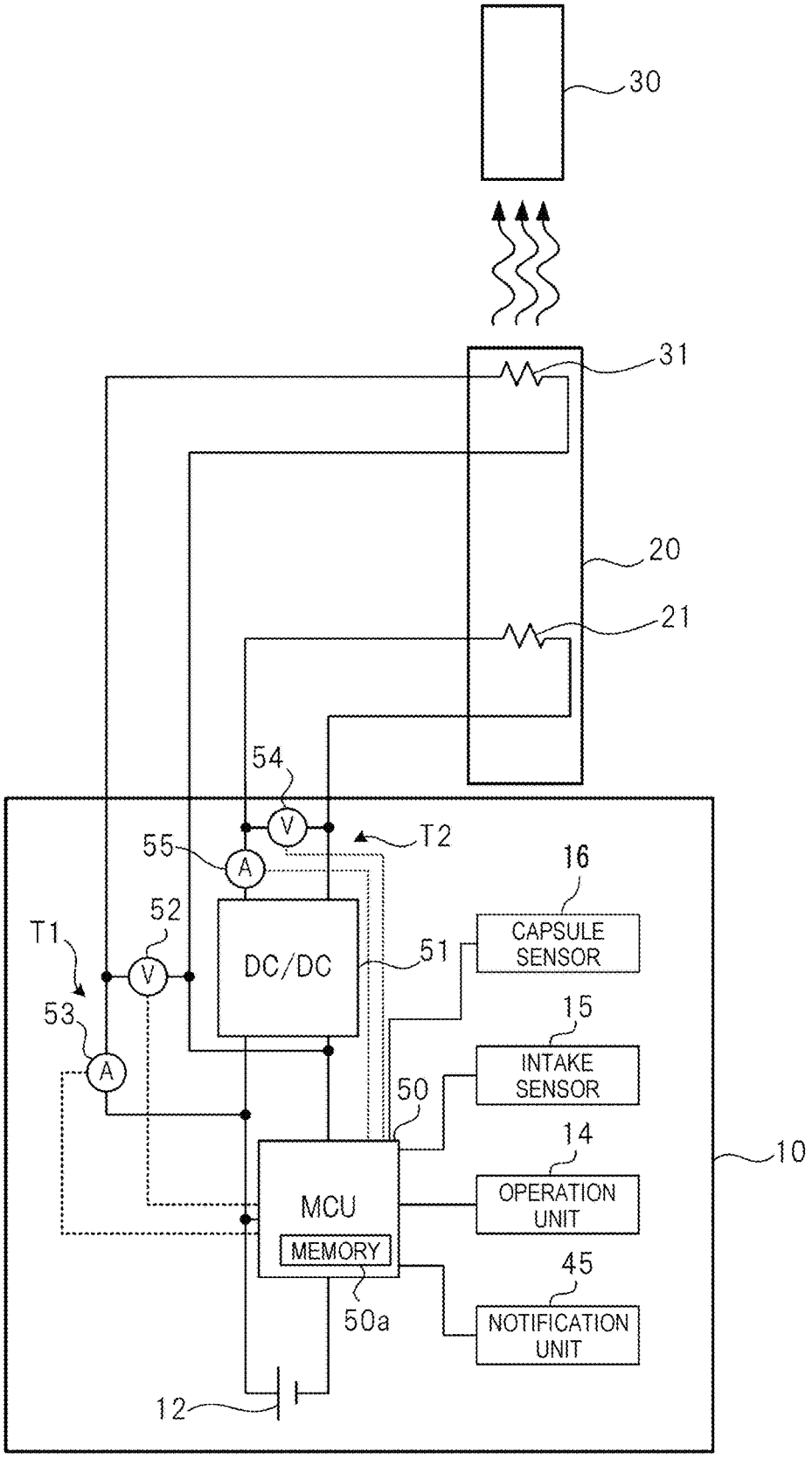
FIG. 6 is a schematic diagram showing a hardware configuration of the aerosol inhaler of FIG. 1.

As shown in FIG. 6, the MCU 50 is connected to various sensor devices such as the intake sensor 15, the capsule sensor 16, the voltage sensor 52, the current sensor 53, the voltage sensor 54, and the current sensor 55, the DC/DC converter 51, an operation unit 14, and a notification unit 45, and performs various controls of the aerosol inhaler 1.

Specifically, the MCU 50 is mainly configured with a processor, and further includes a memory 50*a* configured with a storage medium such as a random access memory (RAM) necessary for an operation of the processor and a read only memory (ROM) that stores various pieces of information. Specifically, the processor in the present description is an electric circuit in which circuit elements such as semiconductor elements are combined.

Figure 4:
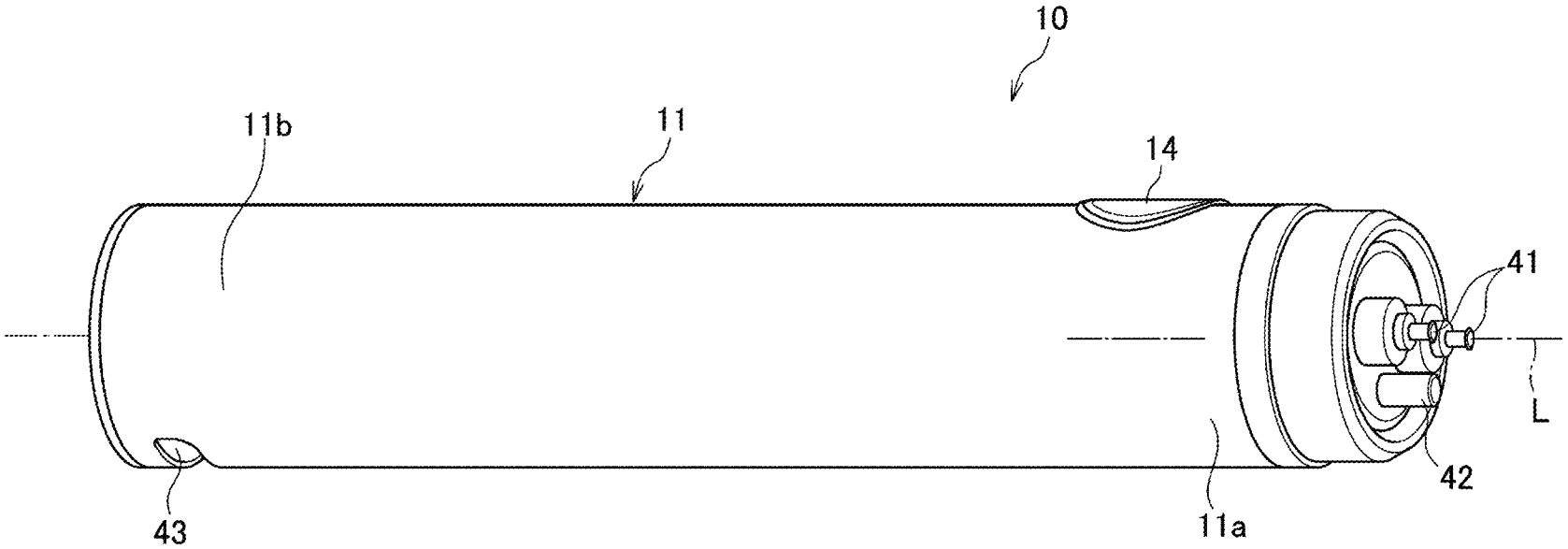
FIG. 4 is a perspective view of a power supply unit in the aerosol inhaler of FIG. 1.

As shown in FIG. 4, discharging terminals 41 are provided on a top portion Ila positioned on one end side of the power supply unit case 11 in the longitudinal direction X (a first cartridge 20 side). The discharging terminal 41 is provided so as to protrude from an upper surface of the top portion 11*a* toward the first cartridge 20, and can be electrically connected to the first load 21 and the second load 31 of the first cartridge 20.

On the upper surface of the top portion 11*a*, an air supply unit 42 that supplies air to the first load 21 of the first cartridge 20 is provided in the vicinity of the discharging terminals 41.

A charging terminal 43 that can be electrically connected to an external power supply (not shown) is provided in a bottom portion 11*b* positioned on the other end side of the power supply unit case 11 in the longitudinal direction X (a side opposite to the first cartridge 20). The charging terminal 43 is provided in a side surface of the bottom portion 11*b*, and can be connected to, for example, a universal serial bus (USB) terminal, a microUSB terminal, or the like.

The charging terminal 43 may be a power reception unit that can receive power transmitted from the external power supply in a wireless manner. In such a case, the charging terminal 43 (the power reception unit) may be configured with a power reception coil. A method for wireless power transfer may be an electromagnetic induction type or a magnetic resonance type. Further, the charging terminal 43 may be a power reception unit that can receive power transmitted from the external power supply in a contactless manner. As another example, the charging terminal 43 can be connected to a USB terminal, a microUSB terminal, or a Lightning terminal, and may include the power reception unit described above.

The power supply unit case 11 is provided with the operation unit 14 that can be operated by a user in the side surface of the top portion 11*a* so as to face a side opposite to the charging terminal 43. More specifically, the operation unit 14 and the charging terminal 43 have a point-symmetrical relationship with respect to an intersection between a straight line connecting the operation unit 14 and the charging terminal 43 and a center line of the power supply unit 10 in the longitudinal direction X. The operation unit 14 is configured with a button-type switch, a touch panel, or the like.

As shown in FIG. 3, the intake sensor 15 that detects a puff (inhale) operation is provided in the vicinity of the operation unit 14. The power supply unit case 11 is provided with an air intake port (not shown) that takes outside air into the power supply unit case 11. The air intake port may be provided around the operation unit 14 or may be provided around the charging terminal 43.

The intake sensor 15 is configured to output a value of a pressure (an internal pressure) change in the power supply unit 10 caused by inhaling of the user through an inhale port 32 described later. The intake sensor 15 is, for example, a pressure sensor that outputs an output value (for example, a voltage value or a current value) corresponding to a pressure in a flow path including an aerosol flow path 25 described later, which changes in accordance with a flow rate of air inhaled from the air intake port toward the inhale port 32 (that is, a puff operation of the user). The intake sensor 15 may output an analog value, or may output a digital value converted from the analog value.

In order to compensate for a pressure to be detected, the intake sensor 15 may include a temperature sensor that detects a temperature (an outside air temperature) of an environment in which the power supply unit 10 is placed. The intake sensor 15 may be configured with a condenser microphone or the like instead of a pressure sensor.

The capsule sensor 16 is a sensor for detecting a mounting state of the second cartridge 30. The capsule sensor 16 may be an electrostatic capacitance sensor that outputs a value of a change in an electrostatic capacitance when the second cartridge 30 is mounted on the power supply unit 10, a sensor that outputs a voltage applied to the first load 21 or the second load 31 when the second cartridge 30 is mounted on the power supply unit 10, or the intake sensor 15 that outputs a pressure change in the flow path including the aerosol flow path 25 when the second cartridge 30 is mounted. In the following description, a case where the capsule sensor 16 is an electrostatic capacitance sensor will be described unless otherwise specified.

When a puff operation is performed and an output value of the intake sensor 15 exceeds a threshold, the MCU 50 determines that an aerosol generation request has been made, and thereafter, when the output value of the intake sensor 15 is smaller than the threshold, the MCU 50 determines that the aerosol generation request has ended. In the aerosol inhaler 1, for a purpose of preventing overheating of the first load 21 or the like, when a period during which the aerosol generation request is made reaches a first default value $t_{upper}$ (for example, 2.4 seconds), it is determined that the aerosol generation request has ended regardless of the output value of the intake sensor 15. That is, the MCU 50 determines that the aerosol generation request has ended when any one of an elapse of the first default value $t_{upper}$ since a start of inhale or a start of discharging to the first load 21 and an end of the inhale is detected. Accordingly, the output value of the intake sensor 15 is used as a signal indicating an aerosol generation request. Therefore, the intake sensor 15 constitutes a sensor that outputs the aerosol generation request.

Instead of the intake sensor 15, the aerosol generation request may be detected based on an operation of the operation unit 14. For example, when the user performs a predetermined operation on the operation unit 14 in order to start inhaling an aerosol, the operation unit 14 may output the signal indicating the aerosol generation request to the MCU 50. In this case, the operation unit 14 constitutes a sensor that outputs the aerosol generation request.

Based on an output value of the capsule sensor 16, the MCU 50 detects a mounting state of the second cartridge 30 to the power supply unit 10, and determines whether the second load 31 can heat the flavor source 33. That is, the MCU 50 determines that the second load 31 can heat the flavor source 33 when mounting of the second cartridge 30 to the power supply unit 10 is detected, and determines that the second load 31 cannot heat the flavor source 33 when the mounting of the second cartridge 30 to the power supply unit 10 is not detected. When it is determined that the second load 31 can heat the flavor source 33, the MCU 50 starts or continues second discharging that is discharging from the power supply 12 to the second load 31 before starting first discharging that is discharging from the power supply 12 to the first load 21. On the other hand, when it is determined that the second load 31 cannot heat the flavor source 33, the MCU 50 causes the notification unit 45 to execute a first notification for notifying the user that the second cartridge 30 is not inserted, and defers or stops the second discharging. Details of these controls will be described later. The start of the second discharging means switching from a state where the second discharging is not executed to a state where the second discharging is executed. The execution of the second discharging immediately after the power supply unit 10 is shifted from a sleep mode described later to an activation mode described later is a specific example of the start of the second discharging. Further, the continuation of the second discharging means that the second discharging that has already been executed is continued to be executed. A specific example of the continuation of the second discharging is to wait for execution of the next first discharging while continuing execution of the second discharging without shifting the power supply unit 10 to the sleep mode described later after ending generation of the aerosol.

The charging IC 55A is disposed close to the charging terminal 43, and controls charging of power input from the charging terminal 43 to the power supply 12. The charging IC 55A may be disposed in the vicinity of the MCU 50.

(First Cartridge)

As shown in FIG. 3, the first cartridge 20 includes, inside a cylindrical cartridge case 27, a reservoir 23 that stores an aerosol source 22, the first load 21 for atomizing the aerosol source 22, a wick 24 that draws the aerosol source from the reservoir 23 to the first load 21, the aerosol flow path 25 through which the aerosol generated by atomizing the aerosol source 22 flows toward the second cartridge 30, an end cap 26 that houses a part of the second cartridge 30, and the second load 31 that is provided in the end cap 26 and for heating the second cartridge 30.

The reservoir 23 is partitioned and formed so as to surround a periphery of the aerosol flow path 25 and stores the aerosol source 22. A porous body such as a resin web or cotton may be housed in the reservoir 23, and the porous body may be impregnated with the aerosol source 22. In the reservoir 23, the porous body on the resin web or the cotton may not be housed and only the aerosol source 22 may be stored. The aerosol source 22 contains a liquid such as glycerin, propylene glycol, or water.

The wick 24 is a liquid holding member that draws the aerosol source 22 from the reservoir 23 to the first load 21 by using a capillary phenomenon. The wick 24 is made of, for example, glass fiber or porous ceramic.

The first load 21 atomizes the aerosol source 22 by heating the aerosol source 22 without burning by power supplied from the power supply 12 via the discharging terminals 41. The first load 21 is configured with an electric heating wire (a coil) wound at a predetermined pitch.

The first load 21 may be an element that can generate the aerosol by heating the aerosol source 22 and atomizing the aerosol source 22. The first load 21 is, for example, a heat generation element. Examples of the heat generation element include a heat generation resistor, a ceramic heater, and an induction heating type heater.

As the first load 21, a load in which a temperature and an electric resistance value have a correlation is used. As the first load 21, for example, a load having positive temperature coefficient (PTC) characteristics in which an electric resistance value increases as a temperature increases is used.

The aerosol flow path 25 is provided on a downstream side of the first load 21 and on a center line L of the power supply unit 10. The end cap 26 includes a cartridge housing portion 26*a* that houses a part of the second cartridge 30, and a communication path 26*b* that communicates the aerosol flow path 25 and the cartridge housing portion 26*a*.

Figure 5:
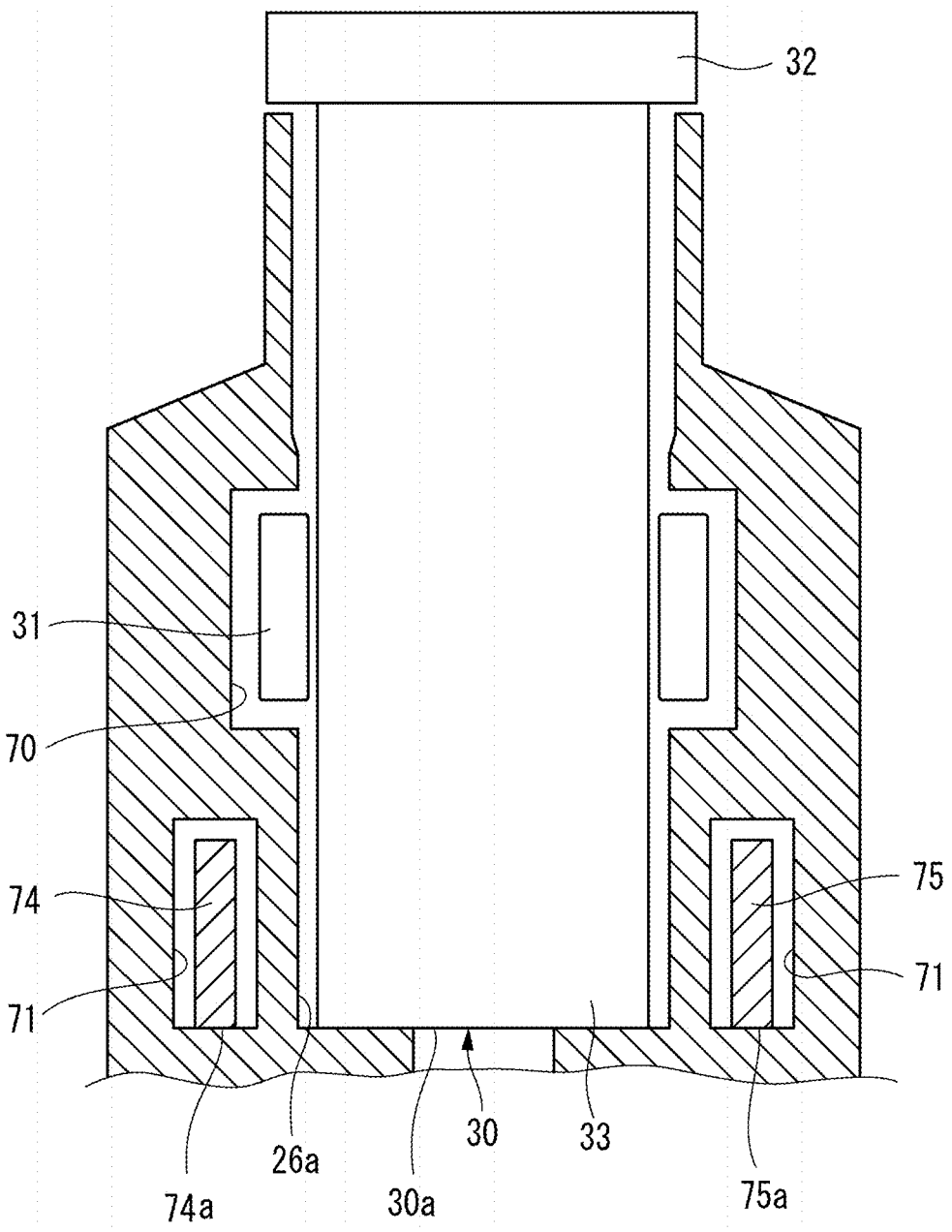
FIG. 5 is a partially enlarged view of FIG. 3.

As shown in FIG. 5, the second load 31 is embedded in a second load housing portion 70 disposed around the cartridge housing portion 26*a*. The second load 31 heats the second cartridge 30 (more specifically, the flavor source 33 included in the second cartridge 30) housed in the cartridge housing portion 26*a* by the power supplied from the power supply 12 via the discharging terminals 41. The second load 31 is configured with, for example, an electric heating wire (a coil) wound at a predetermined pitch.

The second load 31 may be an element that can heat the second cartridge 30. The second load 31 is, for example, a heat generation element. Examples of the heat generation element include a heat generation resistor, a ceramic heater, a stainless tube heater, and an induction heating type heater.

As the second load 31, a load in which a temperature and an electric resistance value have a correlation is used. As the second load 31, for example, a load having the PTC characteristics is used.

A capacitor housing portion 71 is provided below the second load housing portion 70. In the capacitor housing portion 71, a pair of metal plates 74 and 75 are arranged so as to face each other with the cartridge housing portion 26*a* sandwiched therebetween. The pair of metal plates 74 and 75 are arranged parallel to each other along the longitudinal direction X, and constitute a capacitor 77.

The capsule sensor 16 is an electrostatic capacitance sensor that detects an object, a fluid, or the like based on a change in an electrostatic capacitance generated between the pair of metal plates 74 and 75. In the present embodiment, the capsule sensor 16 detects a mounting state of the second cartridge 30 on the first cartridge 20. The MCU 50 measures an electrostatic capacitance of the capacitor 77. According to such a capsule sensor 16, when the second cartridge 30 is inserted between the pair of metal plates 74 and 75, the electrostatic capacitance of the capacitor 77 changes. Therefore, the MCU 50 can detect the mounting state of the second cartridge 30 on the first cartridge 20. That is, the MCU 50 can detect insertion of the second cartridge 30 based on a difference between an electrostatic capacitance of air when the second cartridge 30 is not inserted as a case where the second load 31 cannot heat the flavor source 33 and an electrostatic capacitance when the second cartridge 30 is inserted as a case where the second load 31 can heat the flavor source 33, and can determine whether the second load 31 can heat the flavor source 33.

It is preferable that the pair of metal plates 74 and 75 that constitute the capacitor 77 be arranged such that the MCU 50 acquires an electrostatic capacitance having a maximum value when the insertion of the second cartridge 30 between the metal plates 74 and 75 is completed. For example, lengths of the pair of metal plates 74 and 75 in the longitudinal direction X are shorter than a length of the second cartridge 30 in the longitudinal direction X. In a state where the second cartridge 30 is housed between the pair of metal plates 74 and 75, lower end portions 74*a* and 75*a* of the pair of metal plates 74 and 75 are arranged so as to be positioned at an endpoint in an upper-lower direction where the housing body of the second cartridge 30 reaches, that is, at a point where a lower end portion 30*a* of the second cartridge 30 is.

Accordingly, since a difference between an electrostatic capacitance when the insertion of the second cartridge 30 is completed and an electrostatic capacitance when the second cartridge 30 is not inserted is maximized, the MCU 50 can easily distinguish the difference. Therefore, it is possible to detect whether the second cartridge 30 is inserted with higher accuracy.

The capacitor 77 may be a pseudo capacitor configured with one metal plate 74 and a ground surface (for example, the cartridge case 27) having a GND potential, instead of being configured with the pair of metal plates 74 and 75 facing each other.

(Second Cartridge)

The second cartridge 30 stores the flavor source 33. When the second cartridge 30 is heated by the second load 31, the flavor source 33 is heated. The second cartridge 30 is detachably housed in the cartridge housing portion 26*a* provided in the end cap 26 of the first cartridge 20. In the second cartridge 30, an end portion on a side opposite to a first cartridge 20 side serves as the inhale port 32 of the user. The inhale port 32 is not limited to a case where it is integrally formed inseparably from the second cartridge 30, and may be configured to be detachable from the second cartridge 30. Accordingly, the inhale port 32 can be kept hygienic by configuring the inhale port 32 separately from the power supply unit 10 and the first cartridge 20.

The second cartridge 30 adds a flavor component to the aerosol by passing the aerosol generated by atomizing the aerosol source 22 by the first load 21 through the flavor source 33. As a raw material piece that constitutes the flavor source 33, it is possible to use chopped tobacco or a molded body obtained by molding a tobacco raw material into a granular shape. The flavor source 33 may be composed of a plant other than tobacco (for example, mint, Chinese herb, herb, or the like). A fragrance such as menthol may be added to the flavor source 33.

In the aerosol inhaler 1, the aerosol source 22 and the flavor source 33 can generate an aerosol to which a flavor component is added. That is, the aerosol source 22 and the flavor source 33 constitute an aerosol generation source that generates the aerosol.

The aerosol generation source of the aerosol inhaler 1 is a portion that is replaced and used by the user. The portion is provided to the user, for example, as a set of one first cartridge 20 and one or more (for example, five) second cartridges 30. Therefore, in the aerosol inhaler 1, a replacement frequency of the power supply unit 10 is the lowest, a replacement frequency of the first cartridge 20 is the next lowest, and a replacement frequency of the second cartridge 30 is the highest. Therefore, it is important to reduce manufacturing costs of the first cartridge 20 and the second cartridge 30. The first cartridge 20 and the second cartridge 30 may be integrated into one cartridge.

In the aerosol inhaler 1 configured as described above, as indicated by an arrow B in FIG. 3, air that flows in from the intake port (not shown) provided in the power supply unit case 11 passes through a vicinity of the first load 21 of the first cartridge 20 from the air supply unit 42. The first load 21 atomizes the aerosol source 22 drawn from the reservoir 23 by the wick 24. An aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to add a flavor component and is supplied to the inhale port 32.

The aerosol inhaler 1 is provided with the notification unit 45 for notifying various pieces of information (see FIG. 6). The notification unit 45 may be configured with a light-emitting element, a vibration element, or a sound output element. The notification unit 45 may be a combination of two or more elements among the light-emitting element, the vibration element, and the sound output element. The notification unit 45 may be provided in any of the power supply unit 10, the first cartridge 20, and the second cartridge 30, but it is preferably provided in the power supply unit 10. For example, a configuration in which a periphery of the operation unit 14 has light-transmissive properties and light is emitted by a light-emitting element such as an LED is employed.

(Details of Power Supply Unit)

As shown in FIG. 6, the DC/DC converter 51 is connected between the first load 21 and the power supply 12 in a state where the first cartridge 20 is mounted on the power supply unit 10. The MCU 50 is connected between the DC/DC converter 51 and the power supply 12. The second load 31 is connected to a connection node between the MCU 50 and the DC/DC converter 51 in a state where the first cartridge 20 is mounted on the power supply unit 10. Accordingly, in the power supply unit 10, a series circuit of the DC/DC converter 51 and the first load 21 and the second load 31 are connected in parallel to the power supply 12 in a state where the first cartridge 20 is mounted.

The DC/DC converter 51 is a boosting circuit that can boost an input voltage, and is configured to be able to supply the input voltage or a voltage obtained by boosting the input voltage to the first load 21. Since power supplied to the first load 21 can be adjusted by the DC/DC converter 51, an amount of the aerosol source 22 atomized by the first load 21 can be controlled. As the DC/DC converter 51, for example, a switching regulator that converts an input voltage into a desired output voltage by controlling on/off time of a switching element while monitoring an output voltage can be used. When the switching regulator is used as the DC/DC converter 51, the input voltage can be output as it is without being boosted by controlling the switching element.

The processor of the MCU 50 is configured to be able to acquire a temperature of the flavor source 33 and/or a temperature of the second load 31 in order to control discharging to the second load 31 described later. Further, the processor of the MCU 50 is preferably configured to be able to acquire a temperature of the first load 21. The temperature of the first load 21 can be used to prevent overheating of the first load 21 and the aerosol source 22, and to highly control an amount of the aerosol source 22 atomized by the first load 21.

The voltage sensor 52 measures and outputs a value of a voltage applied to the second load 31. The current sensor 53 measures and outputs a value of a current that flows through the second load 31. An output of the voltage sensor 52 and an output of the current sensor 53 are input to the MCU 50. The processor of the MCU 50 acquires a resistance value of the second load 31 based on the output of the voltage sensor 52 and the output of the current sensor 53, and acquires the temperature of the second load 31 corresponding to the resistance value. The temperature of the second load 31 does not exactly coincide with the temperature of the flavor source 33 heated by the second load 31, but can be regarded as substantially the same as the temperature of the flavor source 33. Therefore, the temperature detection element T1 constitutes a temperature detection element for detecting the temperature of the flavor source 33 and/or the second load 31.

If a constant current flows to the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Instead of the temperature detection element T1, a temperature sensor for detecting the temperature of the second cartridge 30 may be provided in the first cartridge 20. The temperature sensor is configured with, for example, a thermistor disposed in the vicinity of the second cartridge 30. Since the temperature of the second cartridge 30 (flavor source 33) is acquired using the temperature sensor, it is possible to acquire the temperature of the flavor source 33 more accurately than acquiring the temperature of the flavor source 33 by using the temperature detection element T1.

The voltage sensor 54 measures and outputs a value of a voltage applied to the first load 21. The current sensor 55 measures and outputs a value of a current that flows through the first load 21. An output of the voltage sensor 54 and an output of the current sensor 55 are input to the MCU 50. The processor of the MCU 50 acquires a resistance value of the first load 21 based on the output of the voltage sensor 54 and the output of the current sensor 55, and acquires the temperature of the first load 21 corresponding to the resistance value. If a constant current flows to the first load 21 when the resistance value of the first load 21 is acquired, the current sensor 55 is unnecessary in the temperature detection element T2. Similarly, if a constant voltage is applied to the first load 21 when the resistance value of the first load 21 is acquired, the voltage sensor 54 is unnecessary in the temperature detection element T2.

Figure 7:
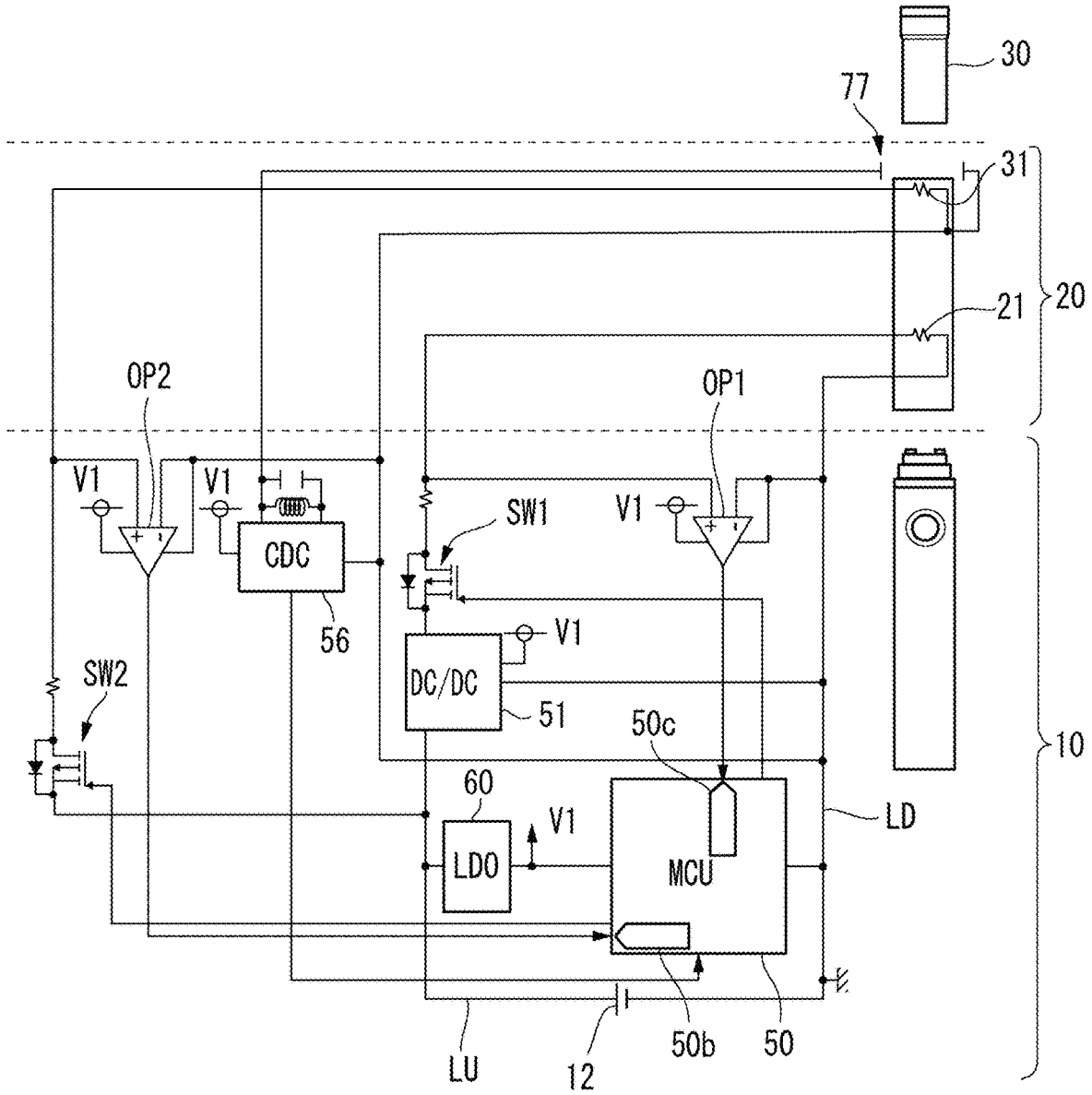
FIG. 7 is a diagram showing a specific example of the power supply unit shown in FIG. 6.

FIG. 7 is a diagram showing a specific example of the power supply unit 10 shown in FIG. 6. FIG. 7 shows a specific example of a configuration in which the temperature detection element T1 does not include the current sensor 53 and the temperature detection element T2 does not include the current sensor 55.

As shown in FIG. 7, the power supply unit 10 includes the power supply 12, the MCU 50, a low drop out (LDO) regulator 60, a switchgear SW1, a switchgear SW2, an operational amplifier OP1 and an analog-to-digital converter (hereinafter, referred to as ADC) 50*c* that constitute the voltage sensor 54, an operational amplifier OP2 and an ADC 50*b* that constitute the voltage sensor 52, and an electrostatic capacitance digital converter (hereinafter, referred to as CDC) 56 that constitutes the capsule sensor 16.

The switchgear described in the present description is a switching element such as a transistor that switches between disconnection and conduction of a wiring path. In an example of FIG. 7, the switchgears SW1 and SW2 are transistors, respectively.

The LDO regulator 60 is connected to a main positive bus LU connected to a positive electrode of the power supply 12. The MCU 50 is connected to the LDO regulator 60 and a main negative bus LD connected to a negative electrode of the power supply 12. The MCU 50 is also connected to the switchgears SW1 and SW2, and controls opening and closing of these switchgears. The MCU 50 is connected to the CDC 56 and detects a change in an electrostatic capacitance of the capacitor 77 or a pseudo capacitor. The LDO regulator 60 steps down a voltage from the power supply 12 and outputs the stepped-down voltage. An output voltage V1 of the LDO regulator 60 is also used as an operation voltage of each of the MCU 50, the DC/DC converter 51, the CDC 56, the operational amplifier OP1, and the operational amplifier OP2.

The DC/DC converter 51 is connected to the main positive bus LU. The first load 21 is connected to the main negative bus LD. The switchgear SW1 is connected between the DC/DC converter 51 and the first load 21.

The switchgear SW2 is connected between the second load 31 connected to the main negative bus LD and the main positive bus LU. The switchgear SW1 and the switchgear SW2 each may be mainly configured with a bipolar transistor such as an insulated gate bipolar transistor (IGBT), a field-effect transistor such as a metal-oxide-semiconductor field-effect transistor (MOSFET), or the like. Alternatively, the switchgear SW1 and the switchgear SW2 each may be configured with a relay.

A non-inverting input terminal of the operational amplifier OP1 is connected to a connection node between the switchgear SW1 and the first load 21. An inverting input terminal of the operational amplifier OP1 is connected to the main negative bus LD.

A non-inverting input terminal of the operational amplifier OP2 is connected to a connection node between the switchgear SW2 and the second load 31. An inverting input terminal of the operational amplifier OP2 is connected to the main negative bus LD.

The ADC 50*c* is connected to an output terminal of the operational amplifier OP1 and converts an output signal of the operational amplifier OP1 into a digital signal. The ADC 50*b* is connected to an output terminal of the operational amplifier OP2 and converts an output signal of the operational amplifier OP2 into a digital signal. The ADC 50*c* and the ADC 50*b* may be provided outside the MCU 50.

The CDC 56 is connected to the capacitor 77 disposed in the vicinity of the cartridge housing portion 26*a*. The CDC 56 includes an L-C resonator, and outputs a digital value to the MCU 50 by using a change in a capacitance of the L-C resonator as a change in a resonance frequency.

(MCU)

Next, a function of the MCU 50 will be described. The MCU 50 includes a temperature detection unit, a power control unit, a capsule detection unit, and a notification control unit as functional blocks implemented by the processor executing a program stored in the ROM.

The temperature detection unit acquires a temperature of the flavor source 33 and/or the second load 31 based on an output of the temperature detection element T1. Further, the temperature detection unit acquires a temperature of the first load 21 based on an output of the temperature detection element T2.

In a case of a circuit example shown in FIG. 7, in a state where the switchgear SW2 is controlled to be in a disconnected state and the switchgear SW1 is controlled to be in a conduction state, the temperature detection unit acquires an output value of the ADC 50*c* (a value of a voltage applied to the first load 21), and acquires the temperature of the first load 21 based on the output value. Further, in a state where the switchgear SW1 is controlled to be in a disconnected state and the switchgear SW2 is controlled to be in a conduction state, the temperature detection unit acquires an output value (a value of a voltage applied to the second load 31) of the ADC 50*b*, and acquires a temperature of the second load 31 based on the output value as the temperature of the flavor source 33 and/or the temperature of the second load 31. In a state where both the switchgear SW1 and the switchgear SW2 are controlled to be in a conductive state, the temperature detection unit may acquire the temperature of the first load 21 and the temperature of the second load 31.

The notification control unit controls the notification unit 45 so as to notify various pieces of information. For example, in response to detection of a replacement timing of the second cartridge 30, the notification control unit controls the notification unit 45 to perform a notification prompting replacement of the second cartridge 30. The notification control unit is not limited to the notification prompting the replacement of the second cartridge 30, but may cause a notification prompting a replacement of the first cartridge 20, a notification prompting a replacement of the power supply 12, a notification prompting charging of the power supply 12, and the like to be performed. Further, when mounting of the second cartridge 30 on the power supply unit 10 is not detected, the notification control unit controls the notification unit 45 to perform a notification (the first notification) that the second load 31 cannot heat the flavor source 33.

The power control unit controls discharging from the power supply 12 to the first load 21 and the second load 31 (discharging necessary for heating the load) in response to a signal indicating the aerosol generation request output from the intake sensor 15.

In the aerosol inhaler 1, the flavor source 33 can be heated by discharging to the second load 31. Therefore, if power discharged to the first load 21 is the same, by heating the flavor source 33, an amount of a flavor component added to the aerosol can be increased as compared with a case where the flavor source 33 is not heated.

A weight[mg] of an aerosol that is generated in the first cartridge 20 and passes through the flavor source 33 by one inhale operation by the user is referred to as an aerosol weight $W_{aerosol}$. Power required to be supplied to the first load 21 for generating the aerosol is referred to as atomization power $P_{liquid}$. A time during which the atomization power $P_{liquid}$ is supplied to the first load 21 for generating the aerosol is referred to as a supply time $t_{sense}$. The supply time $t_{sense}$ has the above-described first default value $t_{upper}$ as an upper limit value per inhale. A weight [mg] of a flavor component contained in the flavor source 33 is referred to as a flavor component remaining amount $W_{capsule}$. Information on a temperature of the flavor source 33 is referred to as a temperature parameter $T_{capsule}$. A weight [mg] of a flavor component added to an aerosol that passes through the flavor source 33 by one inhale operation by the user is referred to as an amount of a flavor component $W_{flavor}$. Specifically, the information on the temperature of the flavor source 33 is the temperature of the flavor source 33 or the second load 31 acquired based on the output of the temperature detection element T1.

It is experimentally found that the amount of the flavor component $W_{flavor}$ depends on the flavor component remaining amount $W_{capsule}$, the temperature parameter $T_{capsule}$, and the aerosol weight $W_{aerosol}$. Therefore, the amount of the flavor component $W_{flavor}$ can be modeled by the following Equation (1).

$$W_{flavor}=\beta\times(W_{capsule}\times T_{capsule})\times\gamma\times W_{aerosol} \quad (1)$$

The β in Equation (1) is a coefficient indicating a ratio of how much of the flavor component contained in the flavor source 33 is added to an aerosol in one inhale, and is experimentally obtained. The γ in Equation (1) is a coefficient obtained experimentally. The temperature parameter $T_{capsule}$ and the flavor component remaining amount $W_{capsule}$ may fluctuate during a period in which one inhale is performed, but in the model, the γ is introduced in order to handle the temperature parameter $T_{capsule}$ and the flavor component remaining amount $W_{capsule}$ as constant values.

The flavor component remaining amount $W_{capsule}$ is decreased every time inhale is performed. Therefore, the flavor component remaining amount $W_{capsule}$ is inversely proportional to the number of times of inhale that is the number of times when inhale is performed (in other words, the cumulative number of times of operations of discharging to the first load 21 for generating an aerosol in response to the aerosol generation request). Further, the flavor component remaining amount $W_{capsule}$ decreases more as a time during which discharging to the first load 21 is performed for aerosol generation in response to inhale is longer. Therefore, the flavor component remaining amount $W_{capsule}$ is also inversely proportional to a cumulative value of the time during which the discharging to the first load 21 is performed for the aerosol generation in response to inhale (hereinafter, referred to as a cumulative discharging time).

As can be seen from the model of Equation (1), when it is assumed that the amount of the $W_{aerosol}$ for each inhale is controlled to be substantially constant, it is necessary to increase the temperature of the flavor source 33 in accordance with a decrease in the flavor component remaining amount $W_{capsule}$ (in other words, an increase in the number of times of inhale or the cumulative discharging time) in order to stabilize the amount of the flavor component $W_{flavor}$.

Therefore, the power control unit of the MCU 50 increases a target temperature of the flavor source 33 (a target temperature $T_{cap_target}$ described below) based on the number of times of inhale or the cumulative discharging time. Then, the power control unit of the MCU 50 controls discharging for heating the flavor source 33 from the power supply 12 to the second load 31 based on the output of the temperature detection element T1 such that the temperature of the flavor source 33 converges to the target temperature. Accordingly, it is possible to increase and stabilize the amount of the flavor component $W_{flavor}$. Specifically, the power control unit of the MCU 50 manages the target temperature in accordance with a table stored in advance in the memory 50*a*. The table stores the number of times of inhale or the cumulative discharging time in association with the target temperature of the flavor source 33.

The target temperature of the flavor source 33 is preferably increased in stages. Frequent changes in the target temperature are prevented by increasing the target temperature in stages. Therefore, the temperature control of the flavor source 33 can be executed more stably while the temperature control of the flavor source 33 is simplified.

(Operation of Aerosol Inhaler)

Figure 8:
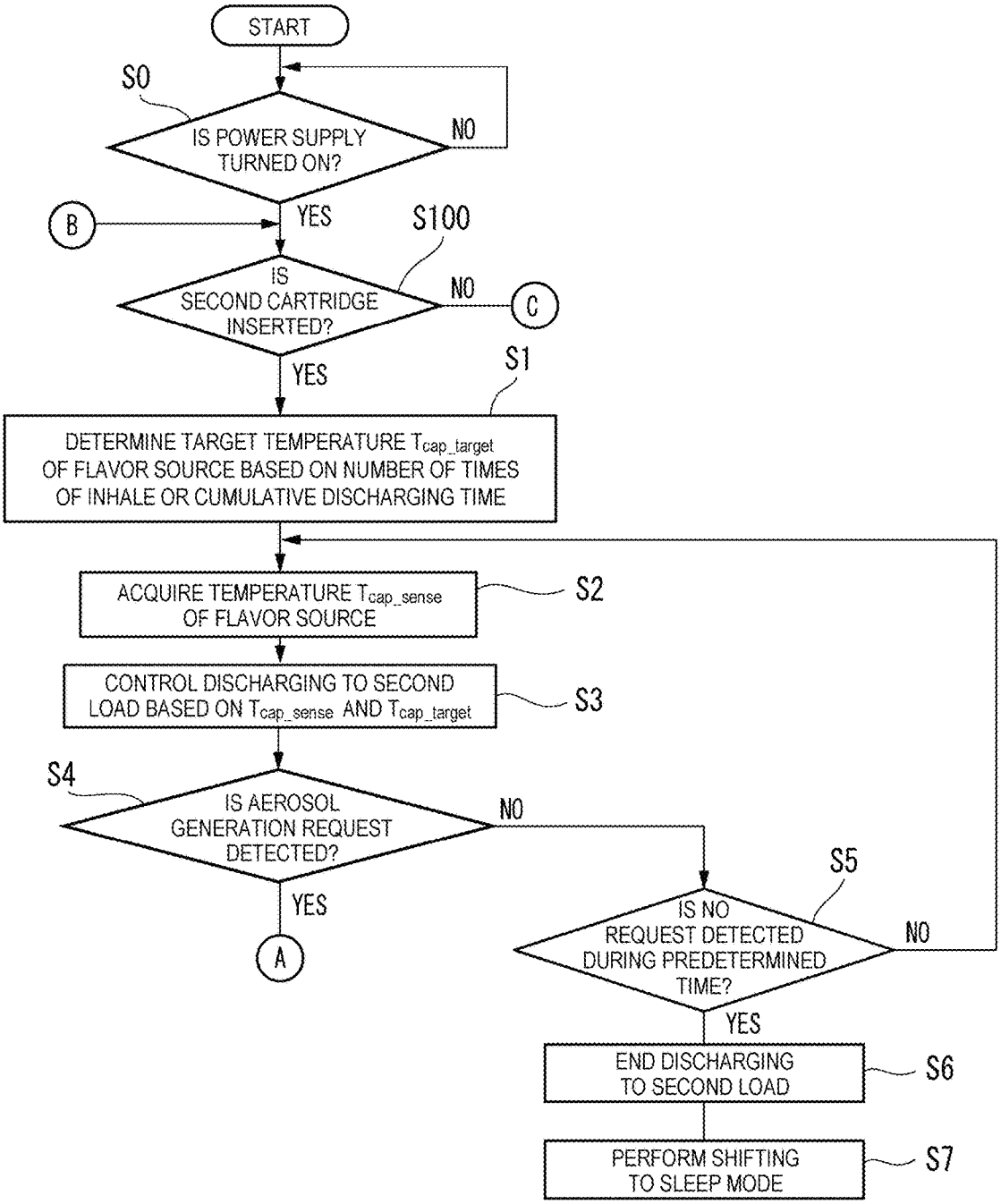
FIG. 8 is a flowchart for illustrating an operation of the aerosol inhaler of FIG. 1.
Figure 9:
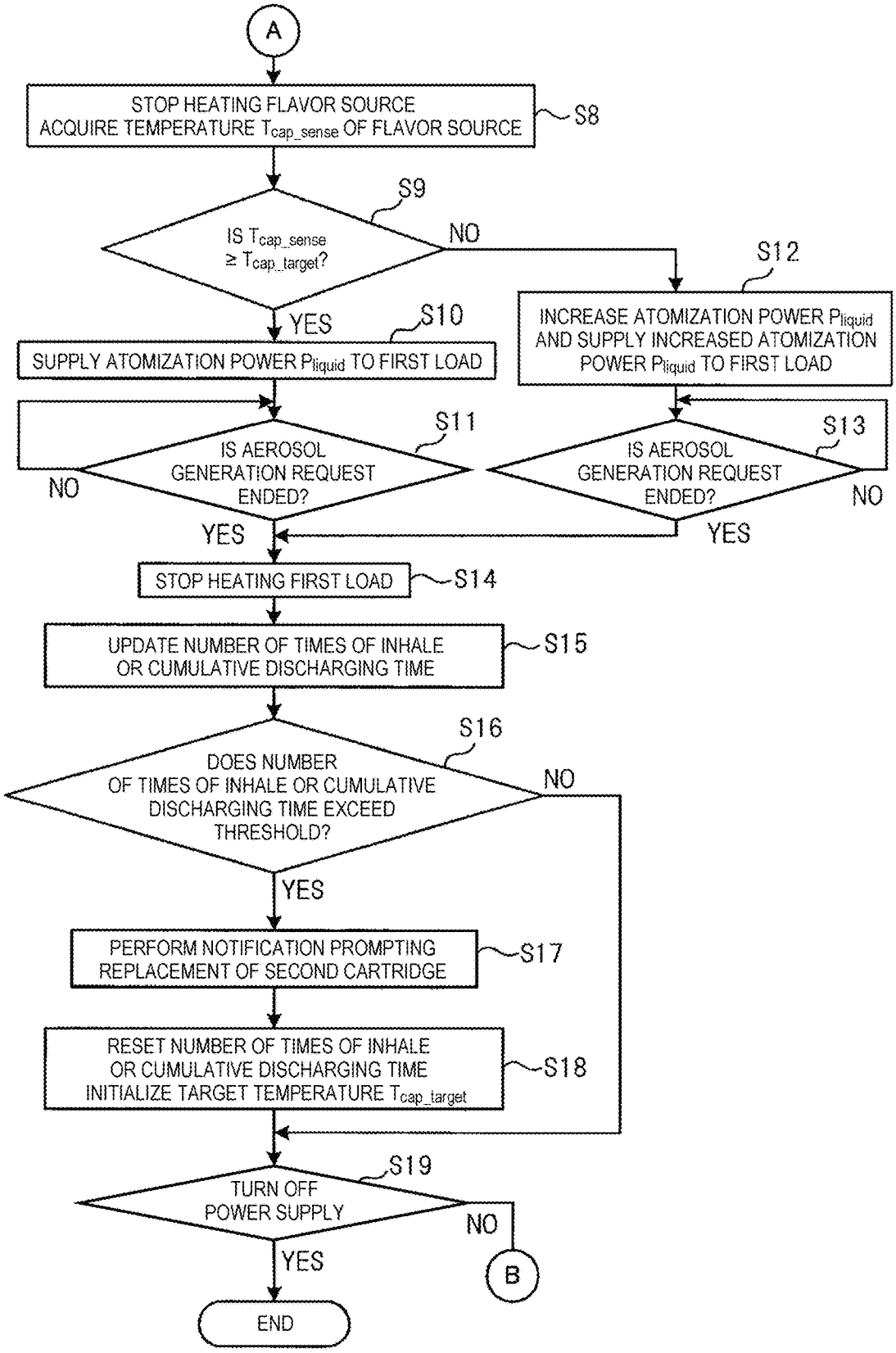
FIG. 9 is a flowchart for illustrating the operation of the aerosol inhaler of FIG. 1.

FIGS. 8 and 9 are flowcharts for illustrating an operation of the aerosol inhaler 1 of FIG. 1. When the power supply of the aerosol inhaler 1 is turned on by an operation of the operation unit 14 or the like (step S0: YES), the MCU 50 causes the power supply unit 10 to operate in an activation mode in which discharging from the power supply 12 to the first load 21 and discharging from the power supply 12 to the second load 31 are possible. Subsequently, the MCU 50 determines whether the second cartridge 30 is inserted, that is, whether the second load 31 can heat the flavor source 33, based on an output of the capsule sensor 16 (step S100). When the second cartridge 30 is inserted (step S100: YES), the MCU 50 determines (sets) the target temperature $T_{cap_target}$ of the flavor source 33 based on the number of times of inhale or the cumulative discharging time stored in the memory 50*a* (step S1).

Next, the MCU 50 acquires a current temperature $T_{cap_sense}$ of the flavor source 33 based on the output of the temperature detection element T1 (step S2).

Then, the MCU 50 controls discharging to the second load 31 for heating the flavor source 33 based on the temperature $T_{cap_sense}$ and the target temperature $T_{cap_target}$ (step S3). In other words, when it is determined that the second load 31 can heat the flavor source 33, the MCU 50 starts the second discharging that is discharging from the power supply 12 to the second load 31 before starting the first discharging that is discharging from the power supply 12 to the first load 21 in step S10 or step S12 described later. Specifically, the MCU 50 supplies power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and power control is performed based on a feedback result thereof such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may use proportional (P) control or proportional-integral (PI) control instead of the PID control.

The ON/OFF control is control in which power is supplied to the second load 31 in a state where the temperature $T_{cap_sense}$ is lower than the target temperature $T_{cap_target}$, and power supply to the second load 31 is stopped until the temperature $T_{cap_sense}$ becomes lower than the target temperature $T_{cap_target}$ in a state where the temperature $T_{cap_sense}$ is equal to or higher than the target temperature $T_{cap_target}$. According to the ON/OFF control, the temperature of the flavor source 33 can be increased faster than the PID control. Therefore, it is possible to increase a possibility that the temperature $T_{cap_sense}$ reaches the target temperature $T_{cap_target}$ at a stage before an aerosol generation request described later is detected. The target temperature $T_{cap_target}$ may have hysteresis.

After step S3, the MCU 50 determines presence or absence of an aerosol generation request (step S4). When the aerosol generation request is not detected (step S4: NO), the MCU 50 determines a length of a time during which the aerosol generation request is not made (hereinafter, referred to as non-operation time) in step S5. Then, when the non-operation time has reached a predetermined time (step S5: YES), the MCU 50 ends discharging to the second load 31 (step S6), and shifts to a sleep mode in which power consumption is reduced (step S7). When the non-operation time is less than the predetermined time (step S5: NO), the MCU 50 shifts the processing to step S2.

When the aerosol generation request is detected (step S4: YES), the MCU 50 ends discharging to the second load 31 for heating the flavor source 33, and acquires the temperature $T_{cap_sense}$ of the flavor source 33 at that time based on the output of the temperature detection element T1 (step S8). Then, the MCU 50 determines whether the temperature $T_{cap_sense}$ acquired in step S8 is equal to or higher than the target temperature $T_{cap_target}$ (step S9).

When the temperature $T_{cap_sense}$ is equal to or higher than the target temperature $T_{cap_target}$ (step S9: YES), the MCU 50 supplies the predetermined atomization power $P_{liquid}$ to the first load 21 to start heating the first load 21 (heating for atomizing the aerosol source 22) (step S10). After the heating of the first load 21 is started in step S10, the MCU 50 continues the heating when the aerosol generation request has not ended (step S11: NO), and stops the power supply to the first load 21 (step S14) when the aerosol generation request has ended (step S11: YES). In step S14, the MCU 50 may also stop the power supply to the second load 31.

When the temperature $T_{cap_sense}$ is lower than the target temperature $T_{cap_target}$ (step S9: NO), the MCU 50 supplies power obtained by increasing the atomization power $P_{liquid}$ by a predetermined amount to the first load 21, and starts heating the first load 21 (step S12). The increase in the power here is performed, for example, in accordance with a table in which a temperature difference between the temperature $T_{cap_sense}$ and the target temperature $T_{cap_target}$ and a power increase amount are associated with each other. After the heating of the first load 21 is started in step S12, the MCU 50 continues the heating when the aerosol generation request has not ended (step S13: NO), and stops the power supply to the first load 21 (step S14) when the aerosol generation request has ended (step S13: YES).

Accordingly, even when the temperature of the flavor source 33 does not reach the target temperature at a time point at which the aerosol generation request is made, an amount of an aerosol to be generated can be increased by performing the processing of step S12. As a result, a decrease in an amount of a flavor component added to an aerosol due to the temperature of the flavor source 33 being lower than the target temperature can be compensated for by the increase in an amount of an aerosol. Therefore, the amount of the flavor component added to the aerosol can converge to the target amount.

After step S14, the MCU 50 updates the number of times of inhale or the cumulative discharging time stored in the memory 50*a* (step S15).

Next, the MCU 50 determines whether the updated number of times of inhale or the updated cumulative discharging time exceeds a threshold (step S16). When the updated number of times of inhale or the updated cumulative discharging time is equal to or smaller than the threshold (step S16: NO), the MCU 50 shifts the processing to step S19. When the updated number of times of inhale or the updated cumulative discharging time exceeds the threshold (step S16: YES), the MCU 50 causes the notification unit 45 to perform a notification prompting a replacement of the second cartridge 30 (step S17). Then, the MCU 50 resets the number of times of inhale or the cumulative discharging time to an initial value (=0), and initializes the target temperature $T_{cap_target}$ (step S18). The initialization of the target temperature $T_{cap_target}$ means that the target temperature $T_{cap_target}$ stored in the memory 50*a* at that time point is excluded from a set value.

After step S18, the MCU 50 returns the processing to step S100 when the power supply is not turned off (step S19: NO), and the MCU 50 ends the processing when the power supply is turned off (step S19: YES).

Figure 10:
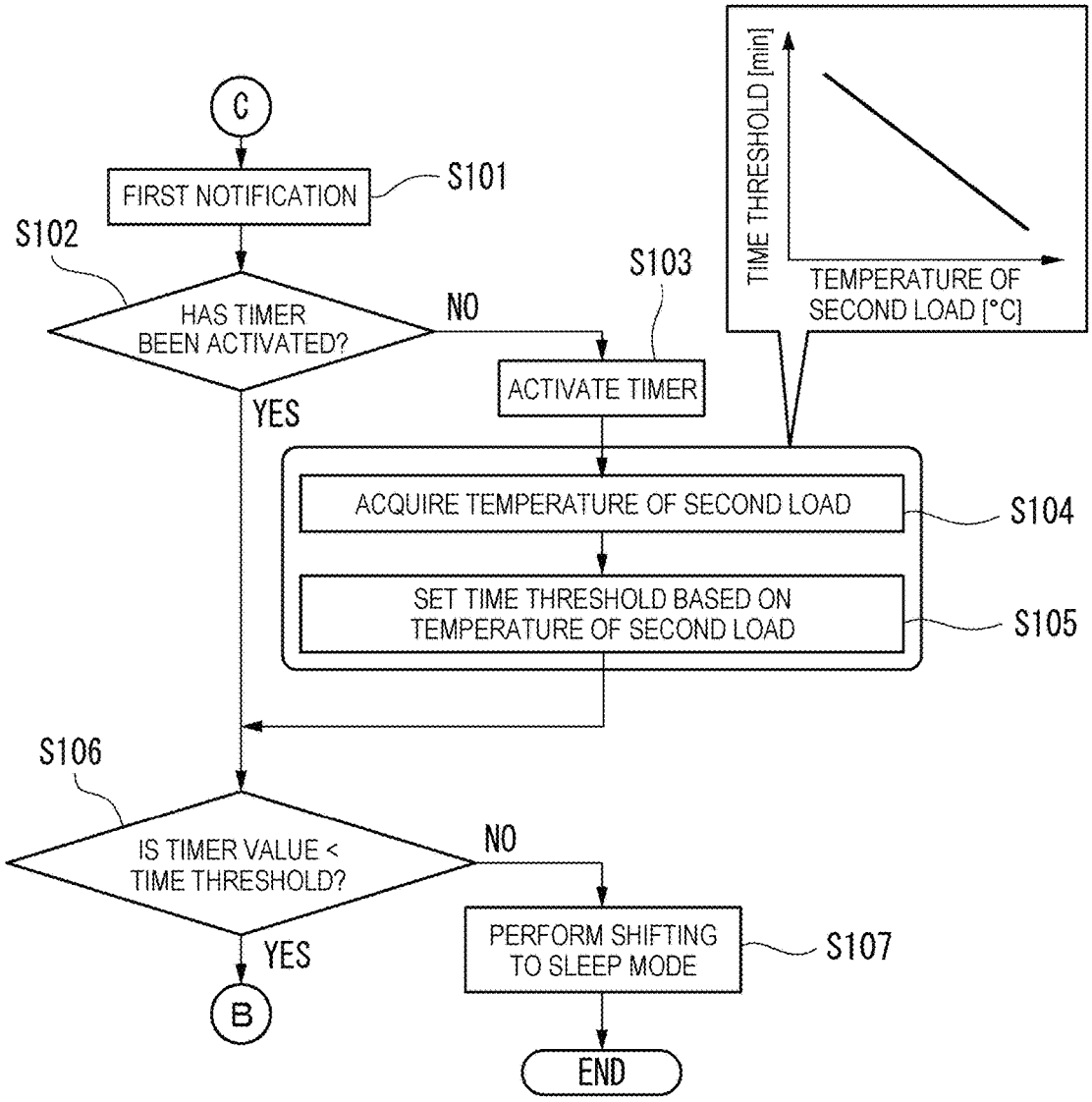
FIG. 10 is a flowchart for illustrating a second cartridge detection processing of the aerosol inhaler of FIG. 1.

Returning to FIG. 8, as a result of step S100, when the second cartridge 30 is not inserted, that is, when it is determined that the second load 31 cannot heat the flavor source 33 (step S100: NO), as shown in FIG. 10, the MCU 50 causes the notification unit 45 to execute the first notification for notifying the user that the second cartridge 30 is not inserted (step S101). In a case where the power supply is turned on in a state where the second cartridge 30 is not mounted in step S0, or in a case where the second cartridge 30 is not mounted in a state where the second cartridge 30 is removed after the replacement notification in step S17, it is determined that the second load 31 cannot heat the flavor source 33. According to the first notification, the user can recognize a state where the flavor source 33 cannot be heated, in other words, a state where a flavor cannot be added to a generated aerosol. Therefore, the user can accurately grasp a state of the aerosol inhaler, and convenience is improved.

Subsequently, the MCU 50 detects whether a timer has been activated (step S102). When the timer has not been activated (step S102: NO), the MCU 50 activates the timer (step S103), acquires the temperature of the second load 31 based on the output of the temperature detection element T1 (step S104), and sets a time threshold based on the temperature of the second load 31 (step S105). The time threshold is a time limit from the execution of the first notification to a shift to the sleep mode in which power consumption is reduced as compared with the activation mode, and varies in accordance with the temperature of the second load 31. In the sleep mode, discharging from the power supply 12 to the first load 21 and the second load 31 cannot be executed.

During an appropriate time limit in accordance with the temperature of the flavor source 33, the activation mode is continued even when the second load 31 cannot heat the flavor source 33. Therefore, by continuing the activation mode when the second load 31 shifts to a state where the flavor source 33 can be heated, the flavor source 33 can be heated early when the second cartridge 30 is inserted, and therefore convenience is improved. On the other hand, if the activation mode is continued indefinitely when the second load 31 cannot heat the flavor source 33, power is wasted. Therefore, by varying the time limit in accordance with the temperature of the flavor source 33, it is possible to keep a balance between power saving and convenience in an appropriate state.

When the time limit is described more specifically, as shown in an upper right graph of FIG. 10, the time limit is set to be shorter as the temperature of the second load 31 becomes higher. Since heat generation inside the power supply unit 10 is prevented by setting the power saving mode, it is possible to lower the temperature of the second load 31 faster than in the activation mode, and it is possible to improve safety.

As a result of step S102, when the timer has been activated, and when the time threshold is set in step S105, subsequently, it is determined whether a timer value is less than the time threshold (step S106). When the timer value is less than the time threshold (step S106: YES), the processing shifts to step S100 described above. When the timer value is equal to or larger than the time threshold (step S106: NO), the power supply unit 10 shifts to the sleep mode (step S107). In other words, when it is determined that the second load 31 cannot heat the flavor source 33, the MCU 50 does not start the second discharging that is discharging from the power supply 12 to the second load 31. A fact that the user replaces the second cartridge 30 during the first notification and does not bring the second load 31 into a state where the flavor source 33 can be heated means that generation of an aerosol to which a flavor is added is not desired. In view of an intention of the user, by shifting the power supply unit 10 to the sleep mode when the timer value exceeds the time threshold, it is possible to implement power saving of the power supply unit 10 without going against the intention of the user.

On the other hand, when the timer value is less than the time threshold (step S106: YES), the processing shifts to step S100, and therefore when the insertion of the second cartridge 30 is confirmed during the first notification (step S100: YES), discharging to the second load 31 is started in step S3, and discharging to the first load 21 is started or restarted in step S10.

When the temperature of the second load 31 acquired in step S104 is equal to or lower than a predetermined threshold (for example, 30° C.), the power supply unit 10 may continue to operate in the activation mode even after the first notification is executed. Since safety can be sufficiently secured when the temperature of the second load 31 is low, convenience can be improved by continuing the operation in the activation mode.

The determination of whether the second cartridge 30 is inserted in step S100 may be executed not only immediately after the power supply of the aerosol inhaler 1 is turned on (step S0: YES), but also immediately after the power supply is not turned off after the aerosol is generated (step S19: NO). When the power supply to the second load 31 is not stopped in step S14, the power supply to the second load 31 is still executed at the timing of step S100 executed immediately after step S19. Unless it is determined in step S100 that the second cartridge 30 is not inserted, the power supply unit 10 does not shift to the sleep mode in step S107. In other words, when it is determined that the second load 31 can heat the flavor source 33, the MCU 50 continues the second discharging that is discharging from the power supply 12 to the second load 31 before starting the first discharging that is discharging from the power supply 12 to the first load 21 in step S10 or step S12 described later. Further, when it is determined that the second load 31 cannot heat the flavor source 33, the MCU 50 does not continue the second discharging that is discharging from the power supply 12 to the second load 31.

(First Modification)

Figure 11:
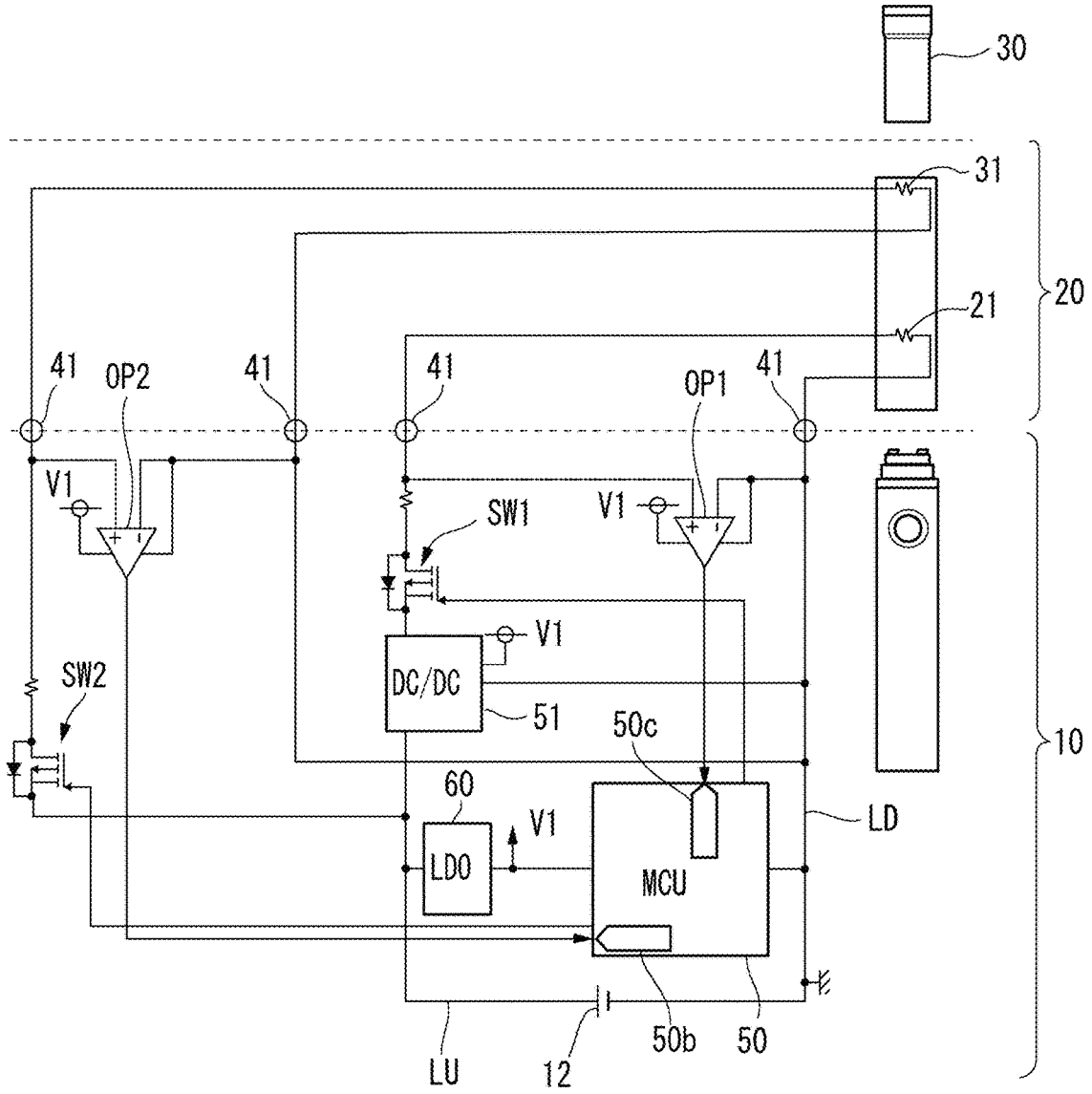
FIG. 11 is a diagram showing a modification of the power supply unit shown in FIG. 6.

Although a case where the capsule sensor 16 is an electrostatic capacitance sensor has already been described above, the capsule sensor 16 may be a sensor that outputs a voltage applied to the first load 21 or the second load 31 when the second cartridge 30 is mounted on the power supply unit 10 as described above. For example, as shown in FIG. 11, the operational amplifier OP2 and the ADC 50*b* that constitute the voltage sensor 52 in the circuit example shown in FIG. 7 can also serve as the capsule sensor 16. In this case, the CDC 56 and the capacitor 77 in the circuit example shown in FIG. 7 are unnecessary, and a cost, a weight, and a volume of the power supply unit 10 can be reduced.

In a circuit diagram shown in FIG. 11, the operational amplifier OP2 and the ADC 50*b* output a voltage value of the second load 31, and the MCU 50 acquires a resistance value of the second load 31 based on the voltage value.

Here, when a non-inverting input voltage of the operational amplifier OP2 is $V_+$, an inverting input voltage of the operational amplifier OP2 is $V_-$, a contact resistance of the discharging terminal 41 on a positive electrode side connected to the second load 31 is $R_{C2+}$, a contact resistance of the discharging terminal 41 on a negative electrode side connected to the second load 31 is $R_{C2-}$, a resistance of a shunt resistor positioned downstream of the switchgear SW2 is $R_{shunt2}$, a resistance of the second load 31 is $R_{heater2}$, and a voltage of the power supply 12 is V, a differential input voltage $V_+-V_-$ of the operational amplifier OP2 is expressed by the following Equation (2).

$$V_+ - V_- = \frac{R_{C2+} + R_{heater2} + R_{C2-}}{R_{shunt} + R_{C2+} + R_{heater2} + R_{C2-}} \times V \tag{2}$$

As shown in (2), the differential input voltage $V_+-V_-$ of the operational amplifier OP2 fluctuates in accordance with the contact resistances $R_{C2+}$ and $R_{C2-}$ of the discharging terminal 41. The MCU 50 acquires an output voltage obtained by multiplying the differential input voltage $V_{+}-V_{-}$ by a differential gain. When the second cartridge 30 is inserted or removed, a stress is applied to the discharging terminal 41 by inserting or removing the second cartridge 30. The stress fairly changes the contact resistances $R_{C2+}$ and $R_{C2-}$ of the discharging terminal 41. That is, the MCU 50 can detect the insertion of the second cartridge 30 based on a change in the output voltage, and can also detect the insertion of the second cartridge 30 based on a change in the resistance value $R_{heater2}$ of the second load 31 calculated based on the output voltage.

Figure 12:
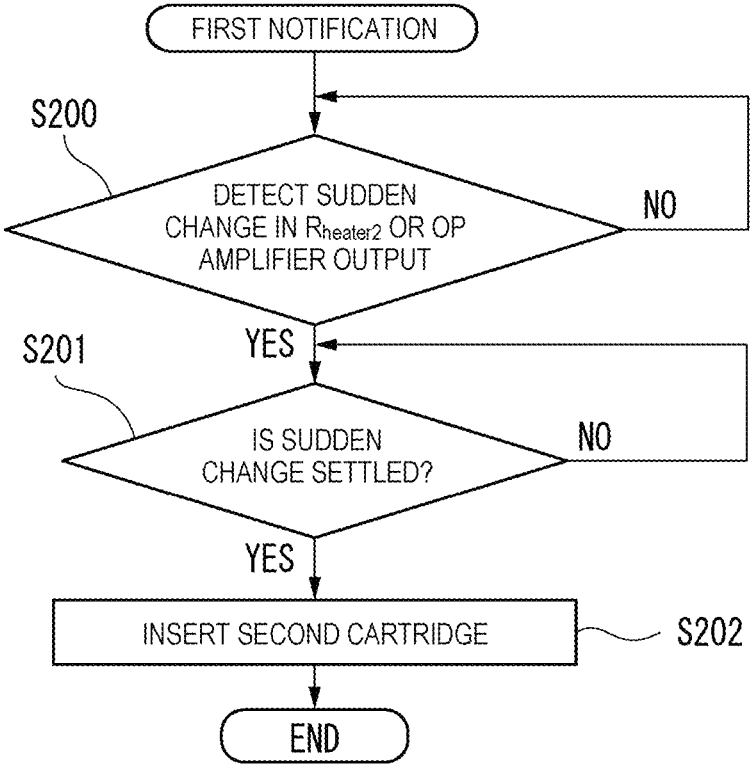
FIG. 12 is a flowchart for illustrating the second cartridge detection processing after a first notification.
Figure 13:
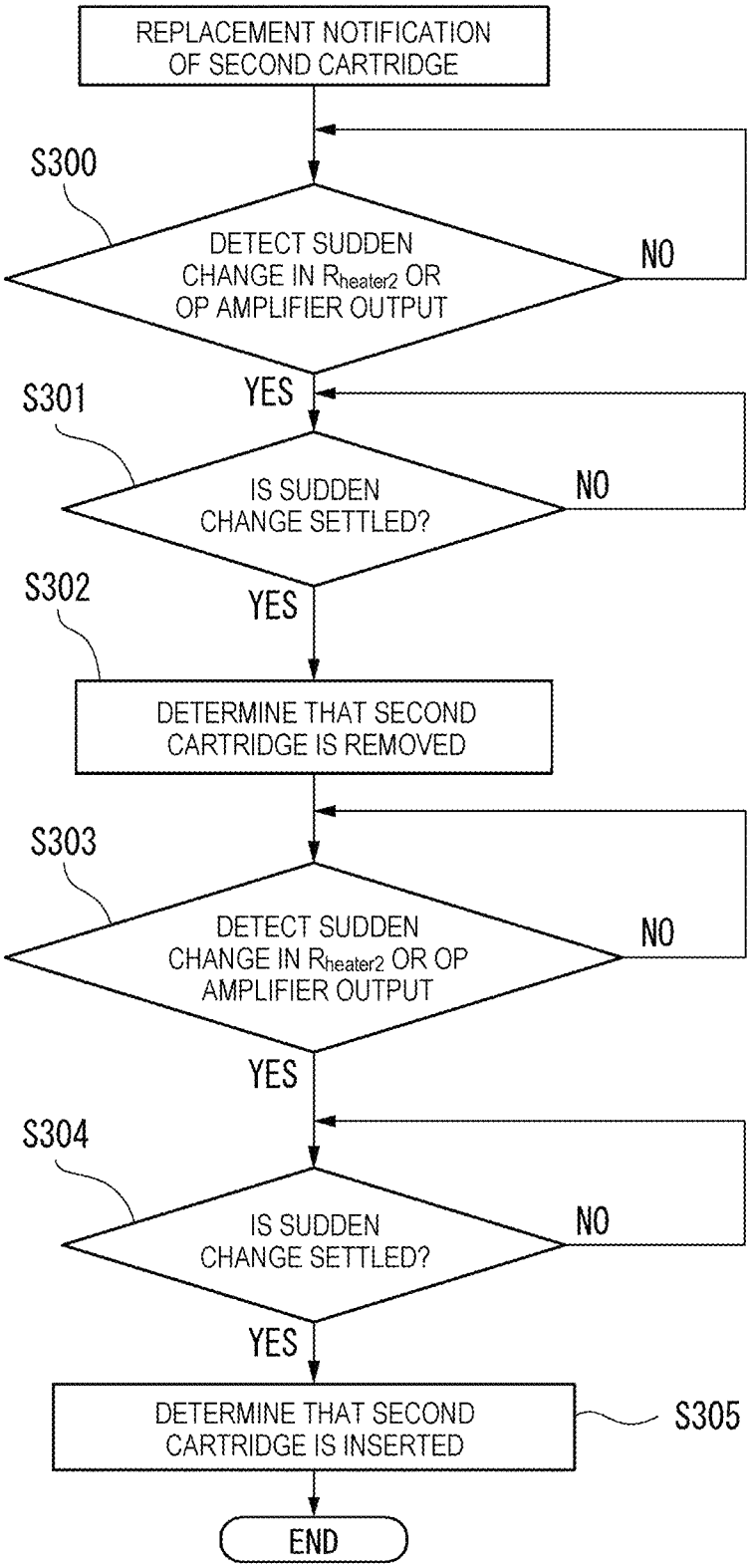
FIG. 13 is a flowchart for illustrating the second cartridge detection processing after a replacement notification of a second cartridge.

FIG. 12 is a flow chart of an insertion detection processing of the second cartridge 30 after the first notification in the first modification. FIG. 13 is a flow chart of an insertion detection processing of the second cartridge 30 after the replacement notification of the second cartridge 30 in the first modification.

As shown in FIG. 12, after the first notification, the MCU 50 determines whether a sudden change in the resistance value $R_{heater2}$ of the second load 31 or an output voltage of the operational amplifier OP2 is detected (step S200). When no sudden change is detected (step S200: NO), the MCU 50 repeats the processing of step S200. On the other hand, when the sudden change in the resistance value $R_{heater2}$ of the second load 31 or the output voltage of the operational amplifier OP2 is detected (step S200: YES), the MCU 50 subsequently determines whether the sudden change is settled (step S201). When the sudden change is not settled (step S201: NO), the MCU 50 repeats the processing of step S201 until the sudden change is settled. When the sudden change is settled (step S201: YES), the MCU 50 determines that the second cartridge 30 is inserted, that is, the second load 31 can heat the flavor source 33 (step S202). The determination in step S200 or step S201 may be executed based on a time differential value of the resistance value $R_{heater2}$ of the second load 31 or the output voltage of the operational amplifier OP2, a difference from a previous value, or the like.

As shown in FIG. 13, after the replacement notification of the second cartridge 30, the MCU 50 determines whether the sudden change in the resistance value $R_{heater2}$ of the second load 31 or the output voltage of the operational amplifier OP2 is detected (step S300). When no sudden change is detected (step S300: NO), the MCU 50 repeats the processing of step S300. On the other hand, when the MCU 50 detects the sudden change in the resistance value $R_{heater2}$ of the second load 31 or the output voltage of the operational amplifier OP2 (step S300: YES), the MCU 50 subsequently determines whether the sudden change is settled (step S301). When the sudden change is not settled (step S301: NO), the MCU 50 repeats the processing of step S301 until the sudden change is settled. When the sudden change is settled (step S301: YES), the MCU 50 determines that the second cartridge 30 is removed, that is, the second load 31 cannot heat the flavor source 33 (step S302).

Subsequently, the MCU 50 determines whether the sudden change in the resistance value $R_{heater2}$ of the second load 31 or the output voltage of the operational amplifier OP2 is detected (step S303). When no sudden change is detected (step S303: NO), the MCU 50 repeats the processing of step S303. On the other hand, when the MCU 50 detects the sudden change in the resistance value $R_{heater2}$ of the second load 31 or the output voltage of the operational amplifier OP2 (step S303: YES), the MCU 50 subsequently determines whether the sudden change is settled (step S304). When the sudden change is not settled (step S304: NO), the MCU 50 repeats the processing of step S304 until the sudden change is settled. When the sudden change is settled (step S304: YES), the MCU 50 determines that the second cartridge 30 is inserted, that is, the second load 31 can heat the flavor source 33 (step S305). The determination in step S300, step S301, step S303, and step S304 may be executed based on a time differential value of the resistance value $R_{heater2}$ of the second load 31 or the output voltage of the operational amplifier OP2, a difference from a previous value, or the like.

It is preferable that the MCU 50 continues to store results of the determination in step S302 and the determination in step S305 even after the power supply unit 10 shifts to the sleep mode in step S107. In this way, even when step S100 is executed immediately after the power supply of the aerosol inhaler 1 is turned on (step S0: YES), the MCU 50 can accurately determine whether the second load 31 can heat the flavor source 33.

In FIGS. 12 and 13, the flows of the insertion detection processing of the second cartridge 30 after the first notification and after the replacement notification of the second cartridge 30 have been described. In addition to these, in a state where it is determined that the second load 31 can heat the flavor source 33, when the sudden change in the resistance value $R_{heater2}$ of the second load 31 or the output voltage of the operational amplifier OP2 is detected, the MCU 50 may determine that the second load 31 cannot heat the flavor source 33. Accordingly, even when step S100 is executed after the determination of NO in steps S16 and S19, the MCU 50 can accurately determine whether the second load 31 can heat the flavor source 33.

(Second Modification)

In the first modification, a case where the operational amplifier OP2 and the ADC 50*b* that constitute the voltage sensor 52 in the circuit example shown in FIG. 7 also serve as the capsule sensor 16 has been described, but the operational amplifier OP1 and the ADC 50*c* that constitute the voltage sensor 54 in the circuit example shown in FIG. 7 may also serve as the capsule sensor 16.

In the present embodiment, since the second cartridge 30 is replaceable with respect to the first cartridge 20, a contact resistance $R_{C1+}$ of the discharging terminal 41 on a positive electrode side connected to the first load 21 and a contact resistance $R_{C1-}$ of the discharging terminal 41 on a negative electrode side connected to the first load 21 are also suddenly changed by attaching and detaching the second cartridge 30. Since a detection principle and a detection flow of the second cartridge 30 in this case are the same as those of the first modification, detailed description thereof will be omitted.

(Third Modification) The operational amplifier OP1 and the ADC 50*c* that constitute the voltage sensor 54 in the circuit example shown in FIG. 7 may be used as another capsule sensor that detects a mounting state of the first cartridge 20, and the operational amplifier OP2 and the ADC 50*b* that constitute the voltage sensor 52 may be used as the capsule sensor 16 that detects a mounting state of the second cartridge 30. It is apparent that an output signal of the operational amplifier OP1 in a state where the first cartridge 20 is mounted is fairly different from an output signal of the operational amplifier OP1 in a state where the first cartridge 20 is not mounted. In this case, not only the replacement of the second cartridge 30 but also the replacement of the first cartridge 20 can be detected.

Therefore, only when it is determined that the first cartridge 20 is mounted and the first load 21 can heat the aerosol source 22 and it is determined that the second cartridge 30 is mounted and the second load 31 can heat the flavor source 33, the MCU 50 may start or continue the second discharging that is the discharging from the power supply 12 to the second load 31 before starting the first discharging that is the discharging from the power supply 12 to the first load 21. Accordingly, only when a condition that an aerosol can be generated and a flavor can be added to the generated aerosol is satisfied, by allowing discharging to the second load 31 that heats the flavor source 33, it is possible to more effectively prevent waste of power accumulated by the power supply 12.

(Fourth Modification)

Further, the capsule sensor 16 may be the intake sensor 15 that outputs a pressure in a flow path including the aerosol flow path 25. The MCU 50 may determine a state where the second cartridge 30 is mounted and the second load 31 can heat the flavor source 33 and a state where the second cartridge 30 is removed and the second load 31 cannot heat the flavor source 33 by detecting a change in an output of the intake sensor 15 due to the attachment and detachment of the second cartridge 30. Accordingly, by determining whether the second load 31 can heat the flavor source 33 by using the intake sensor 15 for activating the first load 21 that generates an aerosol from the aerosol source 22, a dedicated sensor for detecting whether the second load 31 can heat the flavor source 33 is unnecessary. Therefore, a cost, a weight, and a volume of the power supply unit 10 can be reduced. The capsule sensor 16 may be an optical sensor. The MCU 50 may determine whether the second load 31 can heat the flavor source 33 based on a color, a reflectance, and the like of the second cartridge 30 acquired from the optical sensor.

<Second Embodiment>

Next, an aerosol inhaler 1 of a second embodiment will be described.

In the aerosol inhaler 1 of the first embodiment, the power supply unit 10, the first cartridge 20, and the second cartridge 30 are arranged in a line, and the second cartridge 30 is replaceable with respect to the first cartridge 20, but the aerosol inhaler 1 of the second embodiment is different in that the first cartridge 20 and the second cartridge 30 are replaceable with respect to the power supply unit 10. Hereinafter, only differences will be described in detail, the same or equivalent configurations will be denoted by the same reference numerals in FIGS. 14 to 17, and description thereof will be omitted.

(Aerosol Inhaler)

The aerosol inhaler 1 preferably has a size that fits in a hand, and has a substantially rectangular parallelepiped shape. The aerosol inhaler 1 may have an ovoid shape, an elliptical shape, or the like. In the following description, in the substantially rectangular parallelepiped shaped aerosol inhaler, three orthogonal directions are referred to as an upper-lower direction, a front-rear direction, and a left-right direction in descending order of lengths. Further, in the following description, for the sake of convenience, a front side, a rear side, a left side, a right side, an upper side, and a lower side are defined, and the front side is represented by Fr, the rear side is represented by Rr, the left side is represented by L, the right side is represented by R, the upper side is represented by U, and the lower side is represented by D.

(Power Supply Unit)

Figure 14:
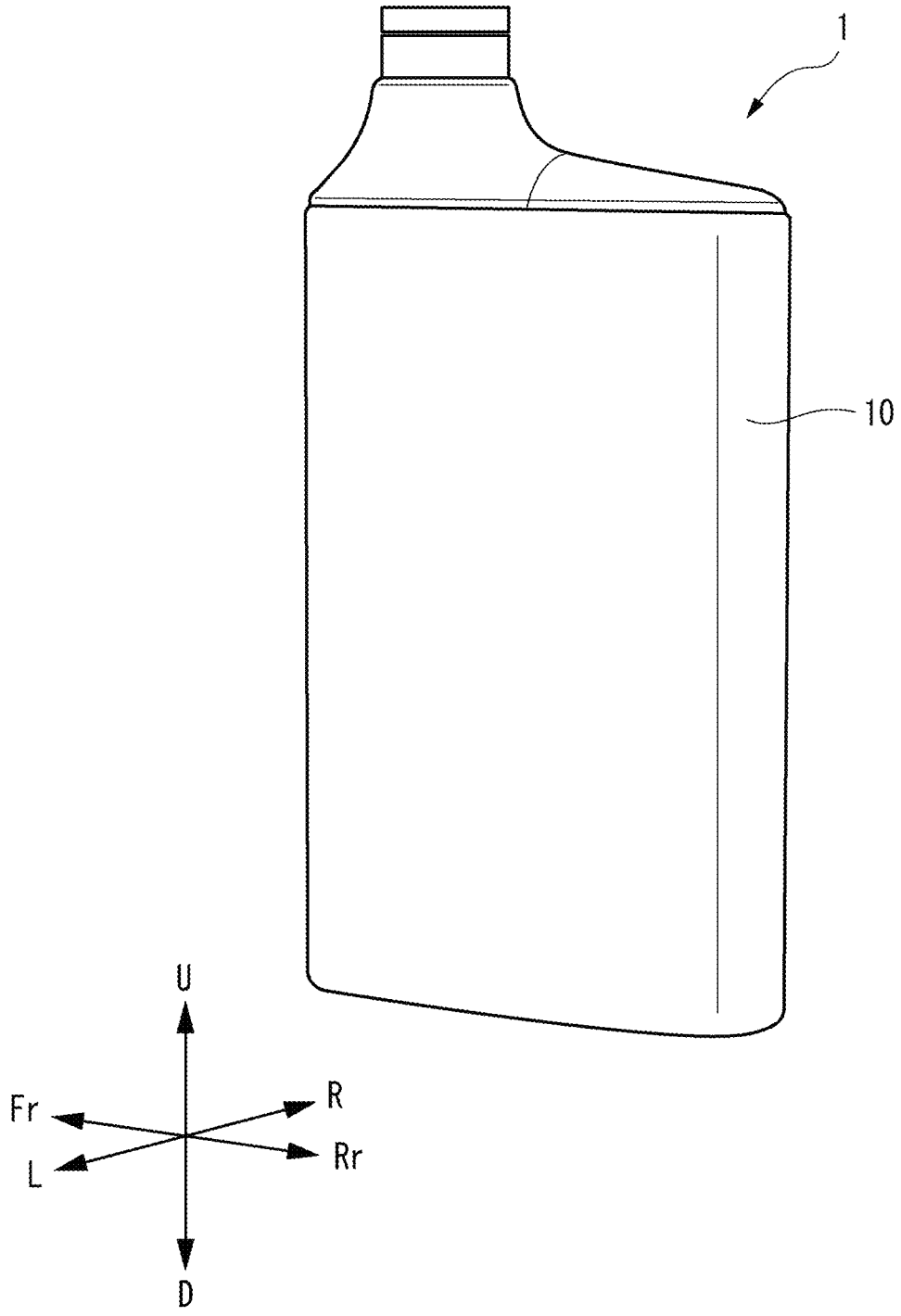
FIG. 14 is a perspective view schematically showing a schematic configuration of an aerosol inhaler of a second embodiment.
Figure 15:
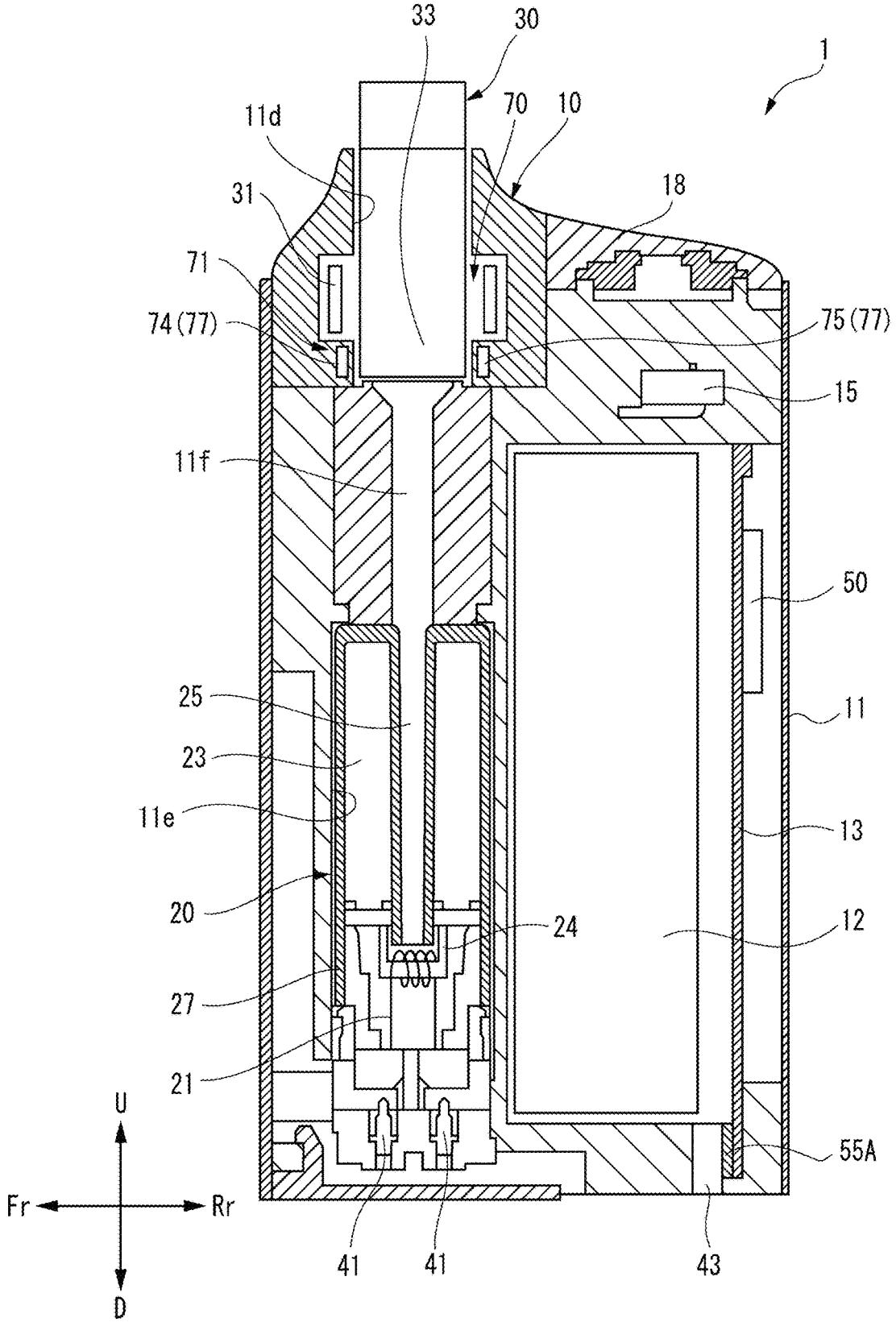
FIG. 15 is a cross-sectional view of the aerosol inhaler of FIG. 14.
Figure 16:
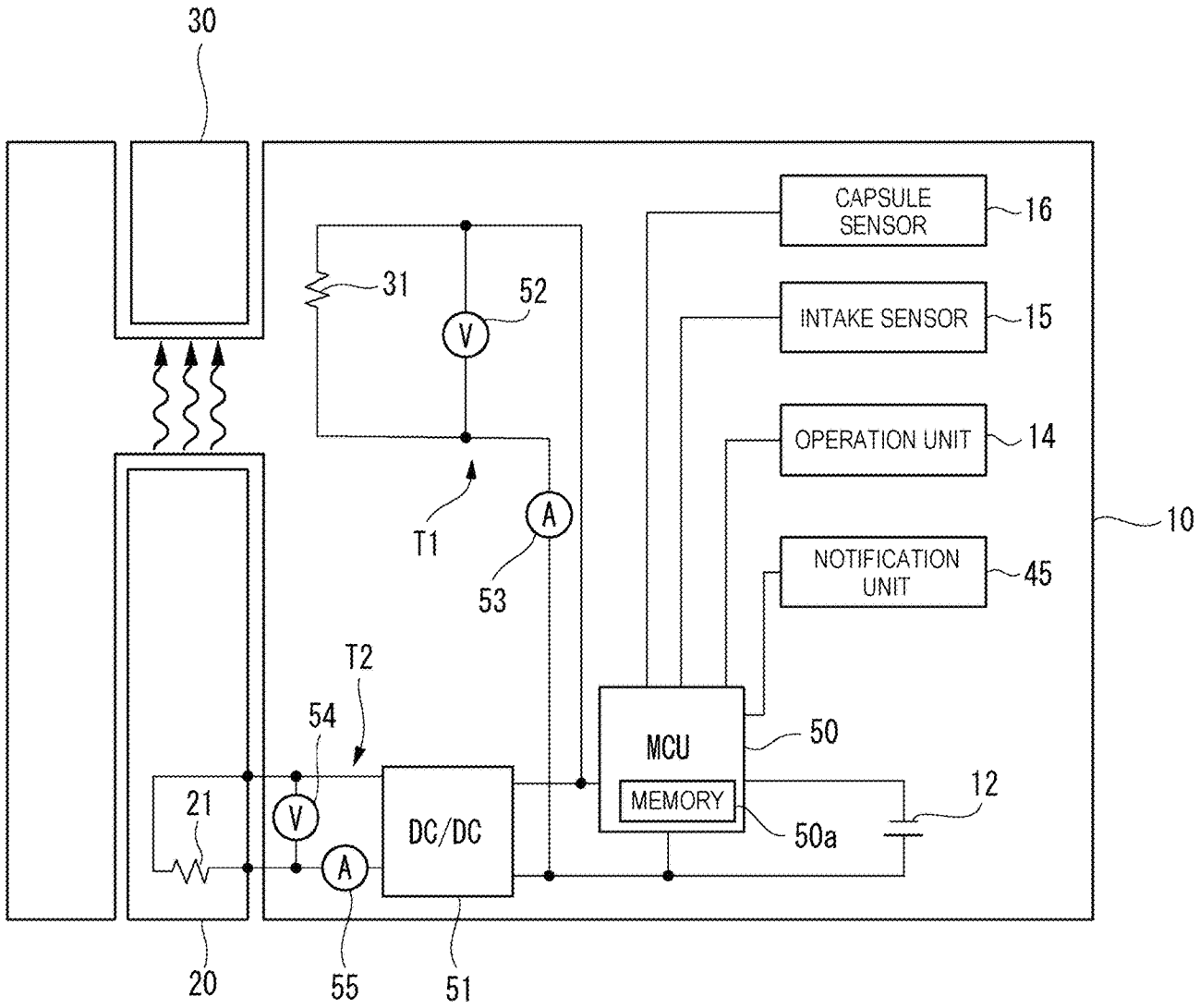
FIG. 16 is a schematic diagram showing a hardware configuration of the aerosol inhaler of FIG. 14.

As shown in FIGS. 14 to 16, the power supply unit 10 houses the power supply 12, the charging IC 55A, the MCU 50, the DC/DC converter 51, the intake sensor 15, the capsule sensor 16, the temperature detection element T1 including the voltage sensor 52 and the current sensor 53, the temperature detection element T2 including the voltage sensor 54 and the current sensor 55, and the second load 31 for heating the second cartridge 30 inside the power supply unit case 11 having the substantially rectangular parallelepiped shape.

On a front side of the power supply unit case 11, a second cartridge housing portion 11*d* that removably houses the second cartridge 30 is provided on an upper side, a first cartridge housing portion 11*e* that removably houses the first cartridge 20 is provided on a lower side, and a communication path 11*f* that communicates the aerosol flow path 25 of the first cartridge 20 with the second cartridge housing portion 11*d* is disposed between the second cartridge housing portion 11*d* and the first cartridge housing portion 11*e* in the upper-lower direction.

On a rear side of the power supply unit case 11, an operation unit 18 operable by a user is disposed on an upper surface, the charging terminal 43 is disposed on a lower surface, and the intake sensor 15 and the power supply 12 are arranged between the operation unit 18 and the charging terminal 43 in the upper-lower direction.

The second load 31 is embedded in the second load housing portion 70 disposed around the second cartridge housing portion 11*d*. The second load 31 heats the second cartridge 30 (more specifically, the flavor source 33 included in the second cartridge 30) housed in the second cartridge housing portion 11*d* by power supplied from the power supply 12.

A capacitor housing portion 71 is provided below the second load housing portion 70. In the capacitor housing portion 71, a pair of metal plates 74 and 75 are arranged so as to face each other with the cartridge housing portion 26*a* sandwiched therebetween. The pair of metal plates 74 and 75 are arranged parallel to each other along an upper-lower direction, and constitute the capacitor 77.

(First Cartridge)

The first cartridge 20 includes the reservoir 23, the first load 21, the wick 24, and the aerosol flow path 25 inside the cylindrical cartridge case 27. Unlike the first embodiment, the end cap 26 that houses a part of the second cartridge 30 and the second load 31 are not provided.

(Second Cartridge)

The second cartridge 30 includes the flavor source 33 and the inhale port 32 as in the first embodiment.

Figure 17:
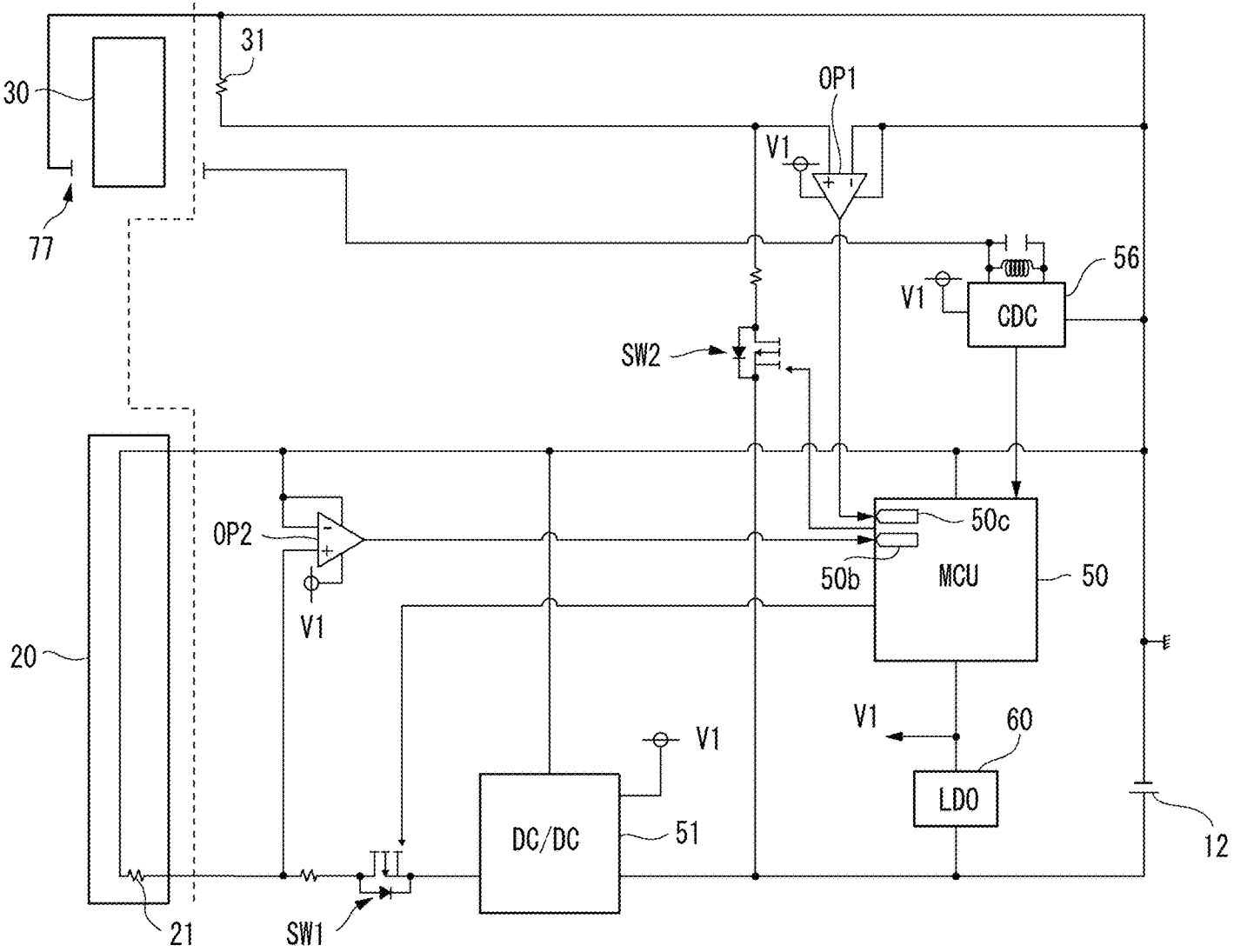
FIG. 17 is a diagram showing a specific example of a power supply unit shown in FIG. 16.

FIG. 16 is a schematic diagram showing a hardware configuration of the aerosol inhaler of the second embodiment. FIG. 17 is a diagram showing a specific example of the power supply unit 10 shown in FIG. 16. The configuration is the same as that shown in FIG. 6 except that the second load 31 is provided in the power supply unit 1. In a circuit example shown in FIG. 17, the capsule sensor 16 may be an electrostatic capacitance sensor (the CDC 56), a sensor that outputs a voltage applied to the first load 21 or the second load 31 when the second cartridge 30 is mounted on the power supply unit 10, or the intake sensor 15 that outputs a pressure change in a flow path including the aerosol flow path 25 when the second cartridge 30 is mounted.

Also in the aerosol inhaler 1 of the present embodiment, when it is determined that the second load 31 can heat the flavor source 33, the MCU 50 starts or continues the second discharging that is discharging from the power supply 12 to the second load 31 before starting the first discharging that is discharging from the power supply 12 to the first load 21. Therefore, since the discharging to the second load 31 that heats the flavor source 33 is prevented in a state where the flavor source 33 cannot be heated, safety of the aerosol inhaler 1 can be improved, and waste of power accumulated by the power supply 12 can be prevented.

According to the present embodiment, when the capsule sensor 16 is configured with the CDC 56, since the capacitor 77 is provided in the power supply unit 10, it is possible to reduce a cost of the first cartridge 20 frequently replaced with a new product. Further, also in the present embodiment, a temperature sensor for detecting a temperature of the second cartridge 30 may be provided instead of the temperature detection element T1, but in this case as well, the cost of the first cartridge 20 can be reduced by providing the temperature sensor in the power supply unit 10.

Although the embodiments are described above with reference to the drawings, it is needless to say that the present invention is not limited to such examples. It will be apparent to those skilled in the art that various changes and modifications may be conceived within the scope of the claims. It is also understood that the various changes and modifications belong to the technical scope of the present invention. Constituent elements in the embodiments described above may be combined freely within a range not departing from the spirit of the present invention.

At least the following matters are described in the present description. Corresponding constituent elements or the like in the above embodiments are shown in parentheses. However, the present invention is not limited thereto.

(1) A power supply unit (the power supply unit 10) for an aerosol inhaler (the aerosol inhaler 1) that causes an aerosol generated from an aerosol source (the aerosol source 22) to pass through a flavor source (the flavor source 33) to add a flavor component of the flavor source to the aerosol, the power supply unit including:

a power supply (the power supply 12) configured to be dischargeable to a first load (the first load 21) configured to heat the aerosol source and dischargeable to a second load (the second load 31) configured to heat the flavor source; and a processing device (the MCU 50), in which the processing device determines whether the second load can heat the flavor source, and in which when it is determined that the second load can heat the flavor source, the processing device starts or continues discharging from the power supply to the second load as second discharging before starting discharging from the power supply to the first load as first discharging.

According to (1), in a state where the flavor source cannot be heated, the discharging to the second load that heats the flavor source is prevented, so that safety of the aerosol inhaler can be improved, and waste of power accumulated by the power supply can be prevented.

(2) The power supply unit according to (1), in which the processing device determines whether the first load can heat the aerosol source, and in which when it is determined that the first load can heat the aerosol source and when it is determined that the second load can heat the flavor source, the processing device starts or continues the second discharging before starting the first discharging.

According to (2), only when a condition that an aerosol can be generated and a flavor can be added to the generated aerosol is satisfied, discharging to the second load that heats the flavor source is allowed, and therefore the waste of the power accumulated by the power supply can be more effectively prevented.

(3) The power supply unit according to (1) or (2), further including:

a notification unit (the notification unit 45), in which when it is determined that the second load cannot heat the flavor source, the processing device causes the notification unit to execute a first notification and defers or stops the second discharging.

According to (3), since a user can recognize a state where the flavor source cannot be heated, in other words, a state where the flavor cannot be added to the generated aerosol, the user can accurately grasp a state of the aerosol inhaler, and convenience is improved.

(4) The power supply unit according to (3), in which when it is determined that the second load can heat the flavor source during execution of the first notification, the processing device starts or restarts the second discharging.

According to (4), when the second load shifts to a state where the flavor source can be heated during the first notification, heating of the flavor source is started or restarted, so that the user can inhale an aerosol to which the flavor is added, and convenience is further improved.

(5) The power supply unit according to (3), in which the processing device can cause the power supply unit to operate in an activation mode and a power saving mode in which power consumption of the power supply unit is smaller than that in the activation mode, in which the processing device determines whether the second load can heat the flavor source in the activation mode, and in which when it is determined that the second load cannot heat the flavor source during execution of the first notification, the processing device causes the power supply unit to operate in the power saving mode.

According to (5), in view of a fact that the user does not bring the second load into a state where the flavor source can be heated during the first notification being an intention of the user that the user does not desire aerosol generation to which a flavor is added, in this case, by shifting the power supply unit to the power saving mode, it is possible to implement power saving of the power supply unit without going against the intention of the user.

(6) The power supply unit according to (1) or (2), further including:

a notification unit; and a first sensor (the capsule sensor 16, the voltage sensor 52) configured to output a temperature of the second load or the flavor source or output a value related to a temperature of the second load or the flavor source, in which the processing device can cause the power supply unit to operate in an activation mode and a power saving mode in which power consumption of the power supply unit is smaller than that in the activation mode and the first discharging and the second discharging are not executable, in which the processing device acquires a temperature of the second load or the flavor source based on an output of the first sensor, in which when it is determined that the second load can heat the flavor source, the processing device executes the second discharging such that a temperature of the second load or the flavor source converges to a target temperature, and in which when it is determined that the second load cannot heat the flavor source, the processing device causes the notification unit to execute a first notification, and the processing device makes a time limit, which is a time from executing the first notification to causing the power supply unit to operate in the power saving mode, different in accordance with a temperature of the second load.

According to (6), the activation mode is continued even when the second load cannot heat the flavor source during an appropriate time limit in accordance with the temperature of the second load. Therefore, it is possible to keep, in an appropriate state, a balance between power saving implemented by shifting to the power saving mode when the second load cannot heat the flavor source and convenience obtained by continuing the activation mode when the second load shifts to a state where the flavor source can be heated.

(7) The power supply unit according to (6), in which the processing device shortens the time limit as a temperature of the second load increases.

According to (7), since heat generation inside the power supply unit is prevented in the power saving mode more than in the activation mode, the time limit, which is a time until the power supply unit is operated in the power saving mode, is continued to be shorter as the temperature of the second load is higher, so that the temperature of the second load can be lowered faster and safety can be improved.

(8) The power supply unit according to (1) or (2), further including:

a notification unit; and a first sensor (the capsule sensor 16, the voltage sensor 52) configured to output a temperature of the second load or the flavor source or output a value related to a temperature of the second load or the flavor source, in which the processing device can cause the power supply unit to operate in an activation mode and a power saving mode in which power consumption of the power supply unit is smaller than that in the activation mode and the first discharging and the second discharging are not executable, in which the processing device acquires a temperature of the second load or the flavor source based on an output of the first sensor, in which when it is determined that the second load can heat the flavor source, the processing device executes the second discharging such that a temperature of the second load or the flavor source converges to a target temperature, in which when it is determined that the second load cannot heat the flavor source, the processing device causes the notification unit to execute a first notification, and in which when it is determined that the second load cannot heat the flavor source during execution of the first notification and when a temperature of the second load is equal to or lower than a threshold, the processing device continues to cause the power supply unit to operate in the activation mode even after the execution of the first notification.

According to (8), since safety can be sufficiently secured when the temperature of the second load is low, the activation mode can be continued, and convenience can be improved.

(9) The power supply unit according to any one of (1) to (8), further including:

a second sensor (the capsule sensor 16, the intake sensor 15) configured to output a pressure in a flow path including an aerosol flow path (the aerosol flow path 25) configured to transport the aerosol generated from the aerosol source to the flavor source, in which the processing device determines a start of the first discharging based on an output of the second sensor, and in which the processing device determines whether the second load can heat the flavor source based on an output of the second sensor.

According to (9), by determining whether the second load can heat the flavor source by using the second sensor for activating the first load that generates an aerosol from the aerosol source, a dedicated sensor for detecting whether the second load can heat the flavor source becomes unnecessary. Therefore, a cost, a weight, and a volume of the power supply unit can be reduced.

(10) The power supply unit according to any one of (1) to (8), in which the processing device can acquire an electrostatic capacitance of a capacitor that can insert a housing body configured to house the flavor source between a first metal plate (the metal plate 74) and a second metal plate (the metal plate 75) facing the first metal plate or between the first metal plate and a ground surface in a predetermined direction, and in which the processing device determines whether the second load can heat the flavor source based on the electrostatic capacitance.

According to (10), it is possible to detect insertion of the flavor source based on a difference between an electrostatic capacitance of air when the flavor source is not inserted as a case where the second load cannot heat the flavor source and an electrostatic capacitance when the flavor source is inserted as a case where the second load can heat the flavor source, and it is possible to determine whether the second load can heat the flavor source.

(11) The power supply unit according to (10), in which the processing device acquires the electrostatic capacitance having a maximum value when insertion of the housing body between the first metal plate and the second metal plate or between the first metal plate and the ground surface in the predetermined direction is completed.

According to (11), since a difference between an electrostatic capacitance when the insertion of the flavor source is completed and an electrostatic capacitance when the flavor source is not inserted is maximized, the processing device can easily distinguish the difference. Accordingly, it is possible to more accurately detect whether the flavor source is inserted.

(12) The power supply unit according to (10), in which a length of the first metal plate in the predetermined direction is shorter than a length of the housing body in the predetermined direction, and in which in a state where the housing body is housed between the first metal plate and the second metal plate, end portions of the first metal plate and the second metal plate are positioned at an endpoint in the predetermined direction where the housing body reaches.

According to (12), since a difference between the electrostatic capacitance when the insertion of the flavor source is completed and the electrostatic capacitance when the flavor source is not inserted is maximized, the processing device can easily distinguish the difference. Accordingly, it is possible to more accurately detect whether the flavor source is inserted.

(13) The power supply unit according to any one of (1) to (8), in which the processing device can acquire a voltage applied to the first load or a voltage applied to the second load, and in which the processing device determines whether the second load can heat the flavor source based on a voltage applied to the first load or a voltage applied to the second load.

According to (13), since it is possible to determine whether the second load can heat the flavor source with a parameter that can be detected at a relatively low cost, such as a current or a voltage, it is possible to reduce a cost, a weight, and a volume of the power supply unit.

(14) An aerosol inhaler (the aerosol inhaler 1) that causes an aerosol generated from an aerosol source (the aerosol source 22) to pass through a flavor source (the flavor source 33) to add a flavor component of the flavor source to the aerosol, the aerosol inhaler including:

a flavor source unit (the second cartridge 30) including the flavor source;

an aerosol source unit (the first cartridge 20) including the aerosol source and a first load (the first load 21) configured to heat the aerosol source; and a power supply unit (the power supply unit 10) configured such that the flavor source unit and the aerosol source unit are detachable, in which the power supply unit includes a second load (the second load 31) configured to heat the flavor source;

a power supply (the power supply 12) configured to be dischargeable to the first load and dischargeable to the second load; and a processing device (the MCU 50), in which the processing device determines a mounting state of the flavor source unit on the power supply unit, and in which when mounting of the flavor source unit on the power supply unit is recognized, the processing device starts or continues discharging from the power supply to the second load as second discharging before starting discharging from the power supply to the first load as first discharging.

According to (14), in a state where the mounting of the flavor source unit on the power supply unit is not recognized, discharging to the second load that heats the flavor source is prevented. Therefore, safety of the aerosol inhaler can be improved, and waste of power accumulated by the power supply can be prevented.

(15) An aerosol inhaler (the aerosol inhaler 1) that causes an aerosol generated from an aerosol source (the aerosol source 22) to pass through a flavor source (the flavor source 33) to add a flavor component of the flavor source to the aerosol, the aerosol inhaler including:

a flavor source unit (the second cartridge 30) including the flavor source;

an aerosol source unit (the first cartridge 20) including the aerosol source, a first load configured to heat the aerosol source, and a second load (the second load 31) configured to heat the flavor source, and configured such that the flavor source unit is detachable; and a power supply unit (the power supply unit 10) configured such that the aerosol source unit is detachable, in which the power supply unit includes a power supply (the power supply 12) configured to be dischargeable to the first load and dischargeable to the second load; and a processing device (the MCU 50), in which the processing device determines a mounting state of the flavor source unit on the aerosol source unit, and in which when mounting of the flavor source unit on the aerosol source unit is recognized, the processing device starts or continues discharging from the power supply to the second load as second discharging before starting discharging from the power supply to the first load as first discharging.

According to (15), in a state where the mounting of the flavor source unit on the aerosol source unit is not recognized, discharging to the second load that heats the flavor source is prevented. Therefore, safety of the aerosol inhaler can be improved, and waste of power accumulated by the power supply can be prevented.

(16) An aerosol inhale system (the aerosol inhaler 1) that causes an aerosol generated from an aerosol source (the aerosol source 22) to pass through a flavor source (the flavor source 33) to add a flavor component of the flavor source to the aerosol, the aerosol inhale system including:

a first load (the first load 21) configured to heat the aerosol source;

a second load (the second load 31) configured to heat the flavor source;

a power supply (the power supply 12) configured to be dischargeable to the first load and dischargeable to the second load; and a processing device (the MCU 50), in which the processing device determines whether the second load can heat the flavor source, and in which when it is determined that the second load can heat the flavor source, the processing device starts or continues discharging from the power supply to the second load as second discharging before starting discharging from the power supply to the first load as first discharging.

According to (16), in a state where the flavor source cannot be heated, discharging to the second load that heats the flavor source is prevented. Therefore, safety of the aerosol inhaler can be improved, and waste of power accumulated by the power supply can be prevented.

What is claimed is:

1. A power supply unit for an aerosol inhaler that causes an aerosol generated from an aerosol source to pass through a flavor source to add a flavor component of the flavor source to the aerosol, the power supply unit comprising:

a power supply configured to be dischargeable to a first load configured to heat the aerosol source and dischargeable to a second load configured to heat the flavor source;

a processing device;

a notification unit; and a first sensor configured to output a temperature of the second load or the flavor source or output a value related to a temperature of the second load or the flavor source, wherein the processing device can cause the power supply unit to operate in an activation mode and a power saving mode, the power saving mode having smaller power consumption of the power supply unit than that in the activation mode and disabling discharging from the power supply to the first load as first discharging and discharging from the power supply to the second load as second discharging, wherein the processing device acquires a temperature of the second load or the flavor source based on an output of the first sensor, wherein the processing device determines whether the second load can heat the flavor source, wherein when it is determined that the second load can heat the flavor source, the processing device starts or continues the second discharging before starting the first discharging and executes the second discharging such that a temperature of the second load or the flavor source converges to a target temperature, and wherein when it is determined that the second load cannot heat the flavor source, the processing device causes the notification unit to execute a first notification and makes a time limit, which is a time from executing the first notification to causing the power supply unit to operate in the power saving mode, different in accordance with a temperature of the second load.

2. The power supply unit according to claim 1, wherein the processing device determines whether the first load can heat the aerosol source, and wherein when it is determined that the first load can heat the aerosol source and when it is determined that the second load can heat the flavor source, the processing device starts or continues the second discharging before starting the first discharging.

3. The power supply unit according to claim 1, wherein when it is determined that the second load cannot heat the flavor source, the processing device causes the notification unit to execute a first notification and defers or stops the second discharging.

4. The power supply unit according to claim 3, wherein when it is determined that the second load can heat the flavor source during execution of the first notification, the processing device starts or restarts the second discharging.

5. The power supply unit according to claim 3, wherein the processing device determines whether the second load can heat the flavor source in the activation mode, and wherein when it is determined that the second load cannot heat the flavor source during execution of the first notification, the processing device causes the power supply unit to operate in the power saving mode.

6. The power supply unit according to claim 1, wherein the processing device shortens the time limit as a temperature of the second load increases.

7. The power supply unit according to claim 1, further comprising:

a second sensor configured to output a pressure in a flow path including an aerosol flow path configured to transport the aerosol generated from the aerosol source to the flavor source, wherein the processing device determines a start of the first discharging based on an output of the second sensor, and wherein the processing device determines whether the second load can heat the flavor source based on an output of the second sensor.

8. The power supply unit according to claim 1, wherein the processing device can acquire an electrostatic capacitance of a capacitor that can insert a housing body configured to house the flavor source between a first metal plate and a second metal plate facing the first metal plate or between the first metal plate and a ground surface in a predetermined direction, and wherein the processing device determines whether the second load can heat the flavor source based on the electrostatic capacitance.

9. The power supply unit according to claim 8, wherein the processing device acquires the electrostatic capacitance having a maximum value when insertion of the housing body between the first metal plate and the second metal plate or between the first metal plate and the ground surface in the predetermined direction is completed.

10. The power supply unit according to claim 8, wherein a length of the first metal plate in the predetermined direction is shorter than a length of the housing body in the predetermined direction, and wherein in a state where the housing body is housed between the first metal plate and the second metal plate, end portions of the first metal plate and the second metal plate are positioned at an endpoint in the predetermined direction where the housing body reaches.

11. The power supply unit according to claim 1, wherein the processing device can acquire a voltage applied to the first load or a voltage applied to the second load, and wherein the processing device determines whether the second load can heat the flavor source based on the voltage applied to the first load or the voltage applied to the second load.

12. An aerosol inhaler that causes an aerosol generated from an aerosol source to pass through a flavor source to add a flavor component of the flavor source to the aerosol, the aerosol inhaler comprising:

a flavor source unit including the flavor source;

an aerosol source unit including the aerosol source and a first load configured to heat the aerosol source; and a power supply unit configured such that the flavor source unit and the aerosol source unit are detachable, wherein the power supply unit is the one according to claim 1.

13. An aerosol inhaler that causes an aerosol generated from an aerosol source to pass through a flavor source to add a flavor component of the flavor source to the aerosol, the aerosol inhaler comprising:

a flavor source unit including the flavor source;

an aerosol source unit including the aerosol source, a first load configured to heat the aerosol source, and a second load configured to heat the flavor source, and configured such that the flavor source unit is detachable; and a power supply unit configured such that the aerosol source unit is detachable, wherein the power supply unit is the one according to claim 1.

14. A power supply unit for an aerosol inhaler that causes an aerosol generated from an aerosol source to pass through a flavor source to add a flavor component of the flavor source to the aerosol, the power supply unit comprising:

a power supply configured to be dischargeable to a first load configured to heat the aerosol source and dischargeable to a second load configured to heat the flavor source;

a processing device;

a notification unit; and a first sensor configured to output a temperature of the second load or the flavor source or output a value related to a temperature of the second load or the flavor source, wherein the processing device can cause the power supply unit to operate in an activation mode and a power saving mode, the power saving mode having smaller power consumption of the power supply unit than that in the activation mode and disabling discharging from the power supply to the first load as first discharging and discharging from the power supply to the second load as second discharging, wherein the processing device acquires a temperature of the second load or the flavor source based on an output of the first sensor, wherein the processing device determines whether the second load can heat the flavor source, wherein when it is determined that the second load can heat the flavor source, the processing device starts or continues the second discharging before starting the first discharging and executes the second discharging such that a temperature of the second load or the flavor source converges to a target temperature, wherein when it is determined that the second load cannot heat the flavor source, the processing device causes the notification unit to execute a first notification, and wherein when it is determined that the second load cannot heat the flavor source during execution of the first notification and when a temperature of the second load is equal to or lower than a threshold, the processing device continues to cause the power supply unit to operate in the activation mode even after the execution of the first notification.

15. An aerosol inhale system that causes an aerosol generated from an aerosol source to pass through a flavor source to add a flavor component of the flavor source to the aerosol, the aerosol inhale system comprising:

a first load configured to heat the aerosol source;

a second load configured to heat the flavor source;

a power supply configured to be dischargeable to the first load and dischargeable to the second load; and a processing device, a notification unit; and a first sensor configured to output a temperature of the second load or the flavor source or output a value related to a temperature of the second load or the flavor source, wherein the processing device can cause the power supply unit to operate in an activation mode and a power saving mode, the power saving mode having smaller power consumption of the power supply unit than that in the activation mode and disabling discharging from the power supply to the first load as first discharging and discharging from the power supply to the second load as second discharging, wherein the processing device acquires a temperature of the second load or the flavor source based on an output of the first sensor, wherein the processing device determines whether the second load can heat the flavor source, and wherein when it is determined that the second load can heat the flavor source, the processing device starts or continues the second discharging before starting first discharging and executes the second discharging such that a temperature of the second load or the flavor source converges to a target temperature, and wherein when it is determined that the second load cannot heat the flavor source, the processing device causes the notification unit to execute a first notification and makes a time limit, which is a time from executing the first notification to causing the power supply unit to operate in the power saving mode, different in accordance with a temperature of the second load.

* * * * *